US012416144B2

(12) United States Patent
Fang et al.

(10) Patent No.: US 12,416,144 B2
(45) Date of Patent: Sep. 16, 2025

(54) BIDET WASHING APPARATUS WITH DEODORIZING FEATURE

(71) Applicant: 2GO PRODUCTS, LLC, San Diego, CA (US)

(72) Inventors: Nathan Fang, San Diego, CA (US); Anjum Gupta, San Diego, CA (US)

( * ) Notice: Subject to any disclaimer, the term of this patent is extended or adjusted under 35 U.S.C. 154(b) by 0 days.

(21) Appl. No.: 17/980,320

(22) Filed: Nov. 3, 2022

(65) Prior Publication Data

US 2024/0151018 A1 May 9, 2024

(51) Int. Cl.
*E03D 9/00* (2006.01)
*E03D 9/08* (2006.01)

(52) U.S. Cl.
CPC ..... *E03D 9/005* (2013.01); *E03D 9/08* (2013.01)

(58) Field of Classification Search
CPC ..... E03D 9/005; E03D 9/08
USPC ..... 4/420.4–5, 420
See application file for complete search history.

(56) References Cited

U.S. PATENT DOCUMENTS

| | | | | |
|---|---|---|---|---|
| 7,076,812 | B2 * | 7/2006 | Haberkorn | E03D 9/08 4/420.4 |
| 2013/0145537 | A1 * | 6/2013 | Al-Jafar | A61G 5/125 4/420.5 |
| 2015/0184368 | A1 * | 7/2015 | Plate | E03D 9/005 4/420.4 |
| 2024/0151018 | A1 * | 5/2024 | Fang | E03D 9/005 |

* cited by examiner

*Primary Examiner* — Lori L Baker

(57) ABSTRACT

A bidet washing apparatus includes a control unit connected to one or more water inlets configured to supply water to the control unit, the control unit having one or more control unit switches configured to operate one or more control unit valves for controlling water flow from the one or more water inlets and/or from one or more control unit outlets; a deodorizer housing unit, wherein the housing unit includes a deodorizer container, and a deodorizer pump; a deodorizer tube connected to the deodorizer pump; a deodorizer spray or drop outlet connected to the deodorizer tube; and a nozzle assembly including at least one washing nozzle connected to at least one of the one or more control unit outlets with one or more control unit outlet to nozzle assembly water tubes.

20 Claims, 28 Drawing Sheets

BIDET WASHING APPARATUS WITH DEODORIZING FEATURE

FIELD OF THE INVENTION

The disclosure generally relates to a bidet washing apparatus, and more particularly to a bidet washing apparatus having a deodorizing feature that can store and dispense a deodorizer from a bidet washing system.

BACKGROUND OF THE INVENTION

A bidet apparatus for washing and cleaning body parts were initially developed in the form of a bidet that provided a single spray of water and was permanently built into the toilet bowl. However, such bidets were expensive, and a new generation of bidets was developed that was attachable to the toilet and included a plurality of nozzles for multiple water sprays. Such bidets can be attached to the seat of an existing toilet bowl for washing the private parts of a person.

Various bidet designs have addressed some of the desired effects, such as washing, washing with temperature-regulated water, and drying, However, existing bidets fail to address all concerns related to the designs and functions in the general field of bidets. In addition, many users are embarrassed by odors leaving the toilet and escaping into the air. This is particularly important in bidets used, for example, in a public place or in a busy household.

Currently, there aren't any bidets that include a deodorizing feature. A deodorizing feature would prevent odors from escaping into the air and should be conveniently integrated into a bidet thereby eliminating the need to install a second device and allowing the user not having to remember to spray before sitting down.

SUMMARY OF THE INVENTION

The disclosed embodiments are directed to solving one or more of the problems presented in the prior art, described above, as well as providing additional features that will become readily apparent by reference to the following detailed description when taken in conjunction with the accompanying drawings.

In an embodiment, the disclosure provides a bidet washing apparatus, which includes a control unit fluidically connected to one or more water inlets configured to supply water to the control unit, the control unit including one or more control unit switches configured to operate one or more control unit valves for controlling water flow from the one or more water inlets and/or from one or more control unit outlets; a deodorizer housing unit, wherein the housing unit includes a deodorizer container, and a deodorizer pump; a deodorizer tube fluidically connected to the deodorizer pump; a deodorizer spray or drop outlet fluidically connected to the deodorizer tube; and a nozzle assembly including at least one washing nozzle fluidically connected to at least one of the one or more control unit outlets with one or more control unit outlet to nozzle assembly water tubes.

In one aspect, the disclosure provides a bidet washing apparatus wherein the deodorizer housing unit, the deodorizer container, and the deodorizer pump are attachable to the control unit.

In another aspect, the disclosure provides a bidet washing apparatus wherein the deodorizer pump includes a deodorizer actuator.

In another aspect, the disclosure provides a bidet washing apparatus wherein the deodorizer pump is a bottle pump.

In another aspect, the disclosure provides a bidet washing apparatus wherein the deodorizer pump includes a pump chamber, a spring, a ball, a piston, a pump tube inlet, and a pump tube outlet.

In another aspect, the disclosure provides a bidet washing apparatus wherein the deodorizer spray or drop outlet is reversibly attachable to the nozzle assembly.

In another embodiment, the disclosure provides a bidet washing apparatus, which includes a control unit fluidically connected to one or more water inlets configured to supply water to the control unit, the control unit including one or more control unit switches configured to operate one or more control unit valves for controlling water flow from the one or more water inlets and/or from one or more control unit outlets; a deodorizer container and a deodorizer pump, wherein the deodorizer container and the deodorizer pump are located within the control unit; a deodorizer tube fluidically connected to the deodorizer pump; a deodorizer spray or drop outlet fluidically connected to the deodorizer tube; and a nozzle assembly including at least one washing nozzle fluidically connected to at least one of the one or more control unit outlets with one or more control unit outlet to nozzle assembly water tubes.

In one aspect, the disclosure provides a bidet washing apparatus wherein the deodorizer pump includes a deodorizer actuator.

In another aspect, the disclosure provides a bidet washing apparatus wherein the deodorizer pump is a bottle pump.

In another aspect, the disclosure provides a bidet washing apparatus wherein the deodorizer pump includes a pump chamber, a spring, a ball, a piston, a pump tube inlet, and a pump tube outlet.

In another aspect, the disclosure provides a bidet washing apparatus wherein the deodorizer spray or drop outlet is reversibly attachable to the nozzle assembly.

In another embodiment, the disclosure provides a bidet washing apparatus, which includes a control unit fluidically connected to one or more water inlets configured to supply water to the control unit, the control unit including one or more control unit switches configured to operate one or more control unit valves for controlling water flow from the one or more water inlets and/or from one or more control unit outlets; a deodorizer housing unit, wherein the housing unit includes a deodorizer container, and a deodorizer pump, and wherein the deodorizer housing unit is located distal to the control unit; a deodorizer tube fluidically connected to the deodorizer pump; a deodorizer spray or drop outlet fluidically connected to the deodorizer tube; and a nozzle assembly including at least one washing nozzle fluidically connected to at least one of the one or more control unit outlets with one or more control unit outlet to nozzle assembly water tubes.

In one aspect, the disclosure provides a bidet washing apparatus wherein the deodorizer pump includes a deodorizer actuator.

In another aspect, the disclosure provides a bidet washing apparatus wherein the deodorizer pump is a bottle pump.

In another aspect, the disclosure provides a bidet washing apparatus wherein the deodorizer pump includes a pump chamber, a spring, a ball, a piston, a pump tube inlet, and a pump tube outlet.

In another aspect, the disclosure provides a bidet washing apparatus wherein the deodorizer spray or drop outlet is reversibly attachable to the nozzle assembly.

In another embodiment, the disclosure provides a bidet washing apparatus, which includes: a control unit fluidically connected to one or more water inlets configured to supply water to the control unit, the control unit including one or more control unit switches configured to operate one or more control unit valves for controlling water flow from the one or more water inlets and/or from one or more control unit outlets; a deodorizer housing unit, wherein the housing unit includes a deodorizer aerosol container; a deodorizer tube fluidically connected to the deodorizer aerosol container; a deodorizer spray or drop outlet fluidically connected to the deodorizer tube; and a nozzle assembly including at least one washing nozzle fluidically connected to at least one of the one or more control unit outlets with one or more control unit outlet to nozzle assembly water tubes.

In one aspect, the disclosure provides a bidet washing apparatus, wherein the deodorizer housing unit and the deodorizer aerosol container are attachable to the control unit.

In another aspect, the disclosure provides a bidet washing apparatus, wherein the deodorizer spray or drop outlet is reversibly attachable to the nozzle assembly.

In another aspect, the disclosure provides a bidet washing apparatus, wherein the deodorizer housing unit and deodorizer aerosol container are located within the control unit, or are located distal to the control unit.

Further features and advantages of the disclosure, as well as the structure and operation of various embodiments of the disclosure, are described in detail below concerning the accompanying drawings.

BRIEF DESCRIPTION OF THE DRAWINGS

The disclosure, by one or more various embodiments, is described in detail concerning the following figures, The drawings are provided for purposes of illustration only and merely depict exemplary embodiments of the disclosure. These drawings are provided to facilitate the reader's understanding of the disclosure and should not be considered limiting the breadth, scope, or applicability of the disclosure. It should be noted that for clarity and ease of illustration these drawings are not necessarily made to scale.

DETAILED DESCRIPTION OF EXEMPLARY EMBODIMENTS

Figure 1:
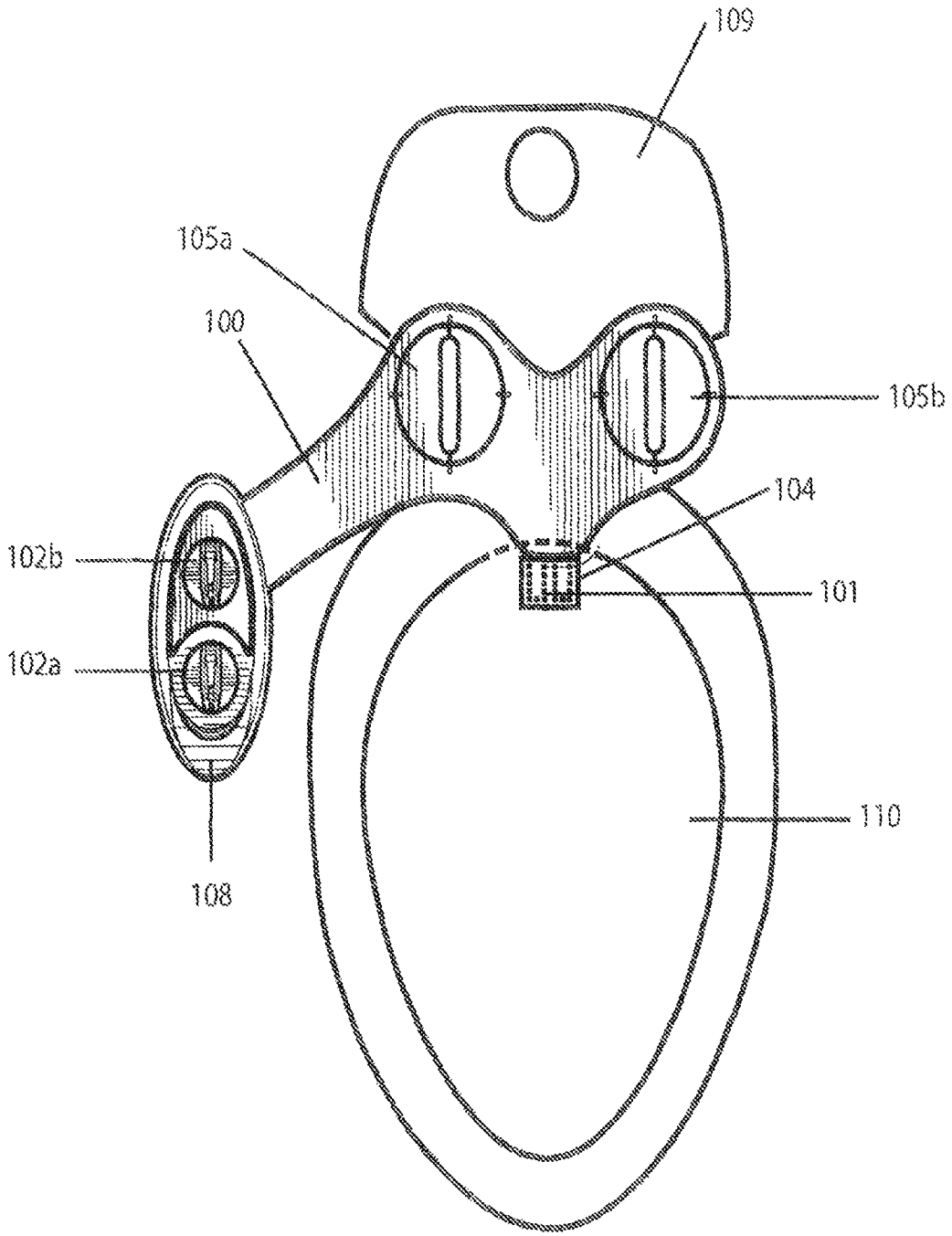
FIG. 1 illustrates an embodiment of a perspective view of an exemplary bidet washing apparatus installed on an existing toilet seat, with a seat cover-up.

The following description is presented to enable a person of ordinary skill in the art to make and use embodiments described herein. Descriptions of specific devices, techniques. and applications are provided only as examples. Various modifications to the examples described herein will be readily apparent to those of ordinary skill in the art, and the general principles defined herein may be applied to other examples and applications without departing from the spirit and scope of the disclosure. Thus, the disclosure is not intended to be limited to the examples described herein and shown but is to be accorded the scope consistent with the claims.

The word "exemplary" is used herein to mean "serving as an example illustration," Any aspect or design described herein as "exemplary" is not necessarily to be construed as preferred or advantageous over other aspects or designs.

Reference will now be made in detail to aspects of the subject technology, examples of which are illustrated in the accompanying drawings, wherein reference numerals refer to like elements throughout.

It should be understood that the specific order or hierarchy of steps in the process disclosed herein is an example of exemplary approaches. Based upon design preferences, it is understood that the specific order or hierarchy of steps in the processes can be rearranged while remaining within the scope of the disclosure. Any accompanying method claims present elements of the various steps in, a sample order, and are not meant to be limited to the specific order or hierarchy presented.

The embodiments disclosed herein describe a new, clean and hygienic washing bidet. The various embodiments include one or a plurality of water inlets, a control means housing one or a plurality of control valves to control the flow of water from the water inlets to one or a plurality of water tubes, one or a plurality of washing nozzles, a protective shield gate, and securing unit configured to securing the sanitary washing device to the toilet seat.

The disclosed embodiments directed to clean and hygienic bidet washing apparatus 100 attachable to an existing toilet, for cleaning the body parts of the user sitting on or near the toilet.

As described herein, a "bidet" is a toilet attachment for cleaning the body parts of the user.

As described herein, the term "water inlet" means any structure that may provide water to the bidet washing apparatus.

As described herein, a "control unit" (aka "control panel") is the housing which has "control switch(s)" thereon controlling the various functionalities of the bidet, including but, not limited to, the flow of water, adjusting the angle of the nozzles, and opening and closing the protective shield gate.

As described herein, "control valves" are, controller parts located inside the control panel housing which control the flow of water or other fluids from the water inlet(s) to one or more "water tubes" by opening, closing, or partially obstructing various passageways.

As described herein, "water tubes" are channels that connect the control valves to a "nozzle assembly," wherein, the "nozzle assembly" includes a single nozzle or a collection of nozzles including at least one "washing nozzle."

As described herein, a "nozzle" is a device designed to eject water or other fluids into the surrounding medium as a coherently controlled spray.

As described herein, the "washing nozzle" is the nozzle that can be used to wash the body parts of a user.

As described herein, the "nozzle assembly" may also have other types of nozzles such as a "self-cleaning nozzle," which is used to clean the nozzle assembly itself, a "toilet cleaning nozzle," which is used to clean the bidet and/or the toilet, and a "shield cleaning nozzle," which is used for cleaning the "protective shield gate."

As described herein, the "protective shield gate" is a structure placed at least partially in front of the nozzle assembly (e.g., between the user and the nozzle assembly) to protect the nozzle assembly from pollutants.

As described herein, the "protective shield gate" has a "hinged" edge. The term "hinged" here means a joint that allows the turning or pivoting of the gate, by any conventional turning or pivoting mechanism.

As described herein, the term "fluidically coupled" means a connection or a passageway that allows fluid to flow therethrough.

As described herein, the term "reservoir" means a fluid holding tank.

Accordingly, in one embodiment the disclosure provides a bidet washing apparatus attachable to a toilet bowl for cleaning one or more body parts of a user. The apparatus can include one or more water inlets configured to supply water, and a control unit, housing one or more valves fluidically connected to the one or more water inlets, including one or more control switches configured to operate the one or more valves. As such, one or more valves can control water flow from one or more water inlets. The apparatus can further include a nozzle assembly including at least one washing nozzle, fluidically connected to at least one of the one or more valves with one or more water tubes. At least one washing nozzle can be positioned for directing water to one or more body parts of the user. The apparatus can also include a protective shield gate covering at least a portion of at least one washing nozzle, where the protective shield gate is rotatably coupled to the bidet washing apparatus.

According to various embodiments, the protective shield gate can be rotatably coupled to the apparatus along a side or top edge via a hinge, for example, to allow for the manual or electrical opening and closing of the protective shield gate. In this matter, the nozzle(s) are easily accessible for cleaning, removal, replacement, or another adjustment while the protective shield gate is open. In an alternative embodiment, the protective shield gate can be completely removed to similarly provide access to the nozzle(s).

According to another embodiment, the water inlet(s) can be fluidically connected to one or more valves via a single-body connector without any intervening parts or joints, which results in a more robust, long-lasting, bidet washing apparatus, since leaks or other damage to the fluidic couplings are less likely to occur.

Figure 2:
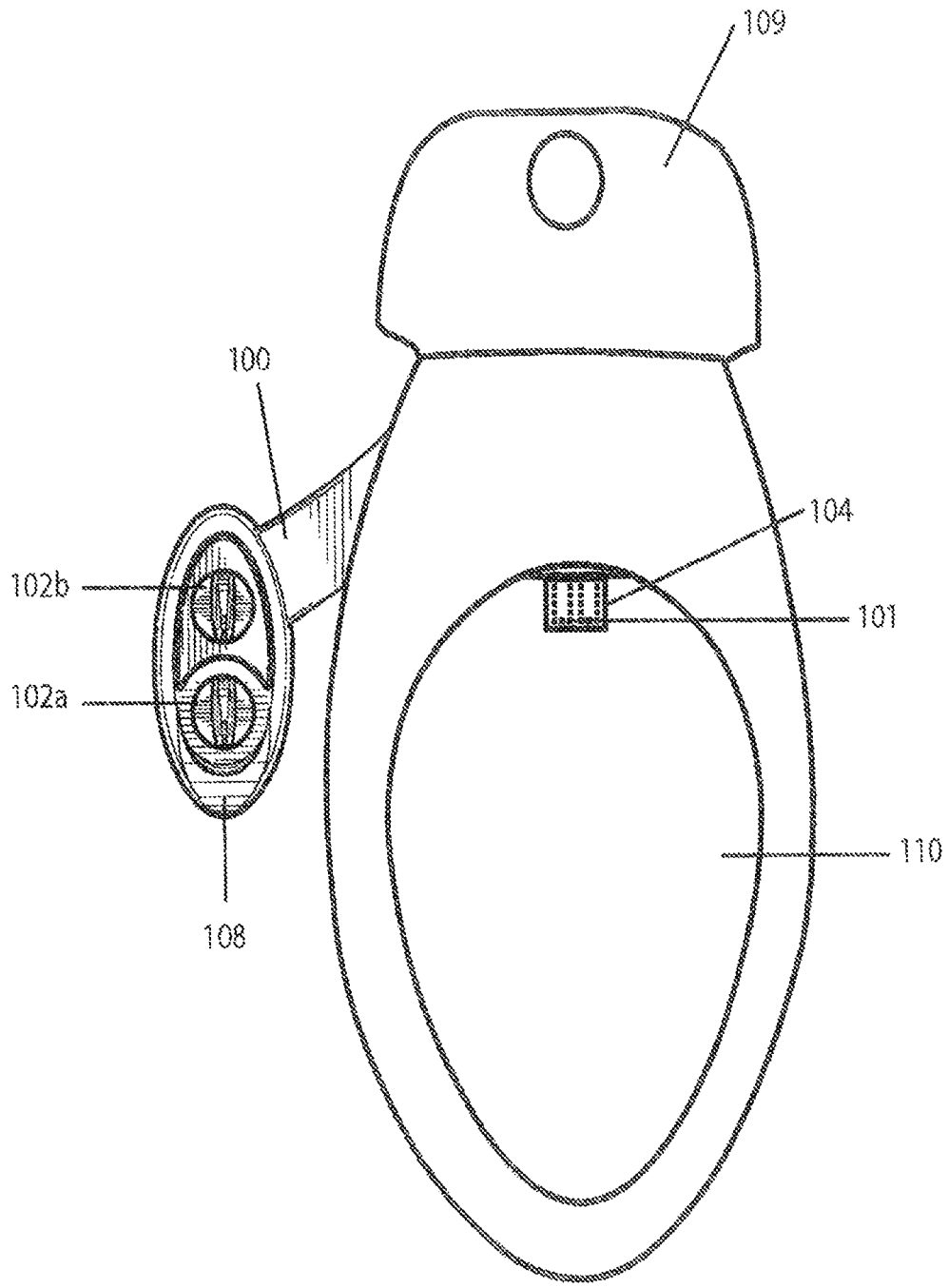
FIG. 2 illustrates an embodiment of a perspective view of a bidet washing apparatus installed on an existing toilet seat, with a seat cover down.

Referring to FIG. 1 and FIG. 2, the bidet washing apparatus 100 of the disclosure can be mounted on a toilet bowl 110 using securing mechanisms 105*a* and 105*b*. Any conventional securing unit can be implemented, e.g., one or more screws. A toilet seat 112 can pivot around and can be connected to a rear portion of the toilet bowl 110. On the rear portion of the toilet bowl, 110 can be mounted a refillable toilet tank 109, in which an amount of water can be stored. In certain embodiments, toilet tank 109 can be used as the water source for the bidet washing apparatus 100 by a fluidic connection. On the bidet washing apparatus, 100 can be mounted a nozzle assembly 101, which includes at least one washing nozzle (not shown) for washing the body parts of the user sitting on or near the toilet bowl 110. The body of the bidet washing apparatus can be made of any suitable material, including but not limited to, plastics, polymers, reinforced polymeric materials, wood, metal and the like, and any combination thereof.

Figure 3:
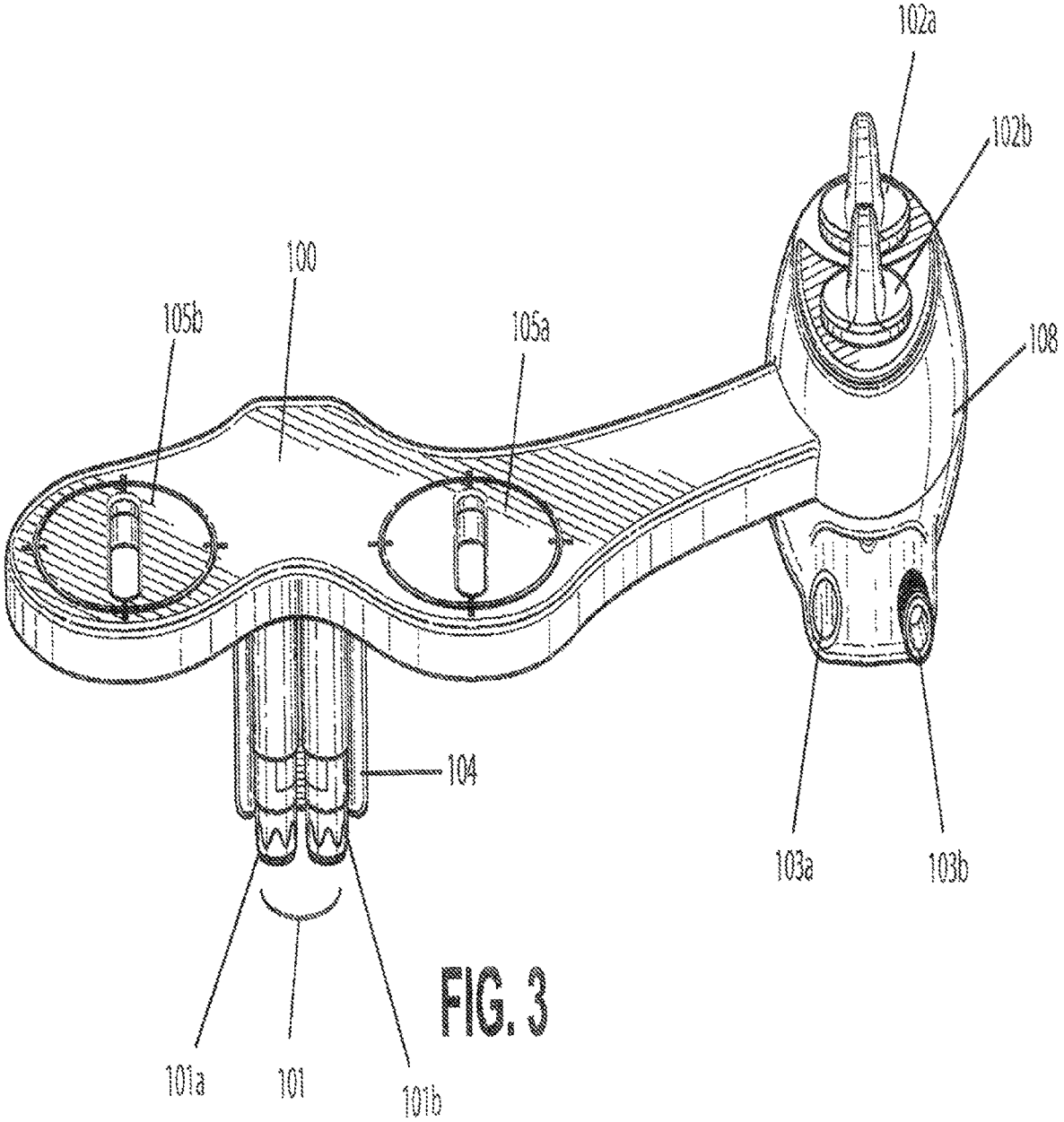
FIG. 3 illustrates an embodiment of a perspective view of an exemplary bidet washing apparatus.

FIG. 3 shows one exemplary embodiment of a bidet washing apparatus 100 with two washing nozzles 101*a* and 101*b*, respectively. However, in an installation, a lesser or greater number of nozzles can be used. Each washing nozzle can spray a stream of water upwardly and inwardly, according to various embodiments.

As shown in FIG. 2 and FIG. 3, a control unit 108 can be provided the easy access for the user, and houses control switches 102*a* and 102*b* for providing operational instructions to the bidet washing apparatus 100. The depicted example shows two switches 102*a* and 102*b*; however, one of ordinary skill in the art would realize that any number of switches can be provided for performing various operations without departing from the scope of the disclosure. Some examples of operational instructions include, but are not limited to, controlling the flow of water from the water inlet, changing the angle of the washing nozzles, and opening and closing the protective shield gate (described in further detail below). The type of control switches can be selected from a group including knobs, dials, levers, depressible buttons, or any conventional control mechanism, An installation may have all similar control switches where both control switches 102*a* and 102*b* are knobs.

Figure 9:
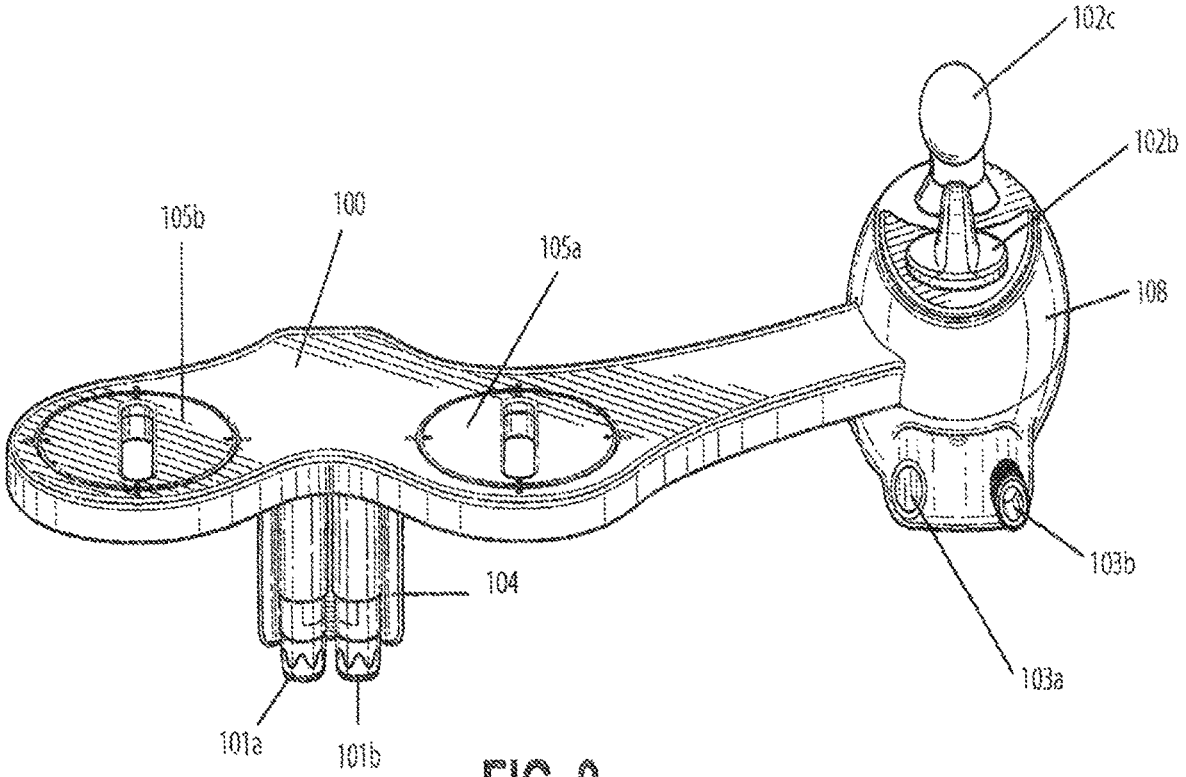
FIG. 9 illustrates an embodiment of a perspective view of an exemplary bidet washing apparatus.

On the other hand, FIG. 9 shows an embodiment of the disclosure where one of the control switches 102*b* is a knob and the other control switch 102*c* is a lever.

Furthermore, as shown in FIG. 1 and FIG. 2, the nozzle assembly 101 can have a protective shield gate 104 substantially or partially in front of it. The position of the protective shield gate 104 is such that it can act as a shield between the user's body and/or water in the toilet bowl 110 and the nozzle assembly 101 thus protecting the nozzle assembly 101 from pollutants during use.

Certain aspects of the bidet washing apparatus will be detailed hereinafter concerning FIGS. 3-9.

FIG. 3 shows a front perspective view of one embodiment described herein. Referring to FIG. 3, the bidet washing apparatus 100 includes the water inlets 103*a* and 103*b* to feed water into the bidet. The water inlet can be controlled by the user using the control switches 102*a* and 102*b* situated on the control unit 108. The water from the water inlets 103*a* and 103*b* can be ultimately provided to the nozzle assembly 101 via tubes (as described in greater detail concerning FIG. 7, for example). The nozzle assembly shown in this aspect of the disclosure has two washing nozzles 101*a* and 101*b*. The protective shield gate 104 protects the nozzle assembly 101 from excrement and pollutants as described above. In this example, the protective shield gate 104 is positioned in front of the nozzle assembly 101 of the bidet such that it is between the user sitting on the toilet seat, for example, and the nozzle assembly. Hence, when the user is using, the toilet, the nozzles are shielded behind the protective shield gate 104 and do not become polluted.

Figure 5:
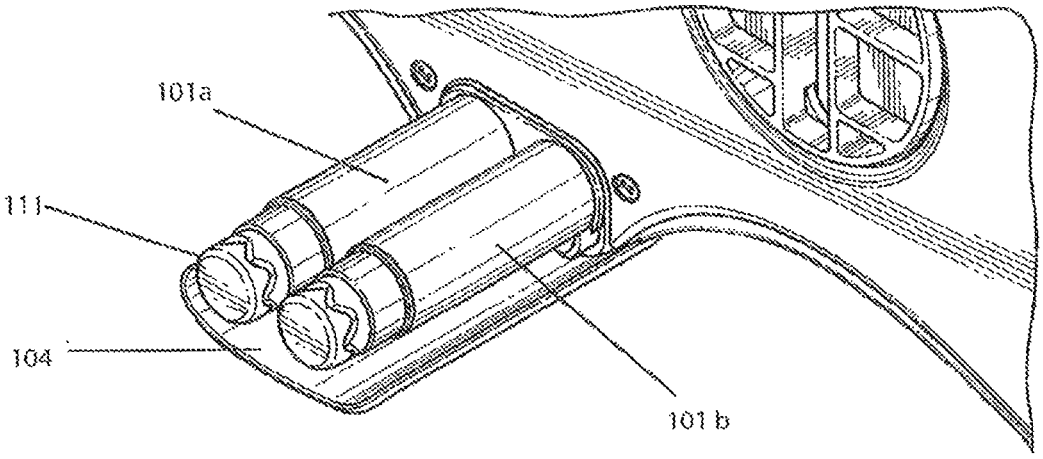
FIG. 5 illustrates an embodiment of a fragmentary view of an exemplary bidet washing apparatus illustrating a gate shield protecting the nozzle assembly in a closed position.
Figure 6:
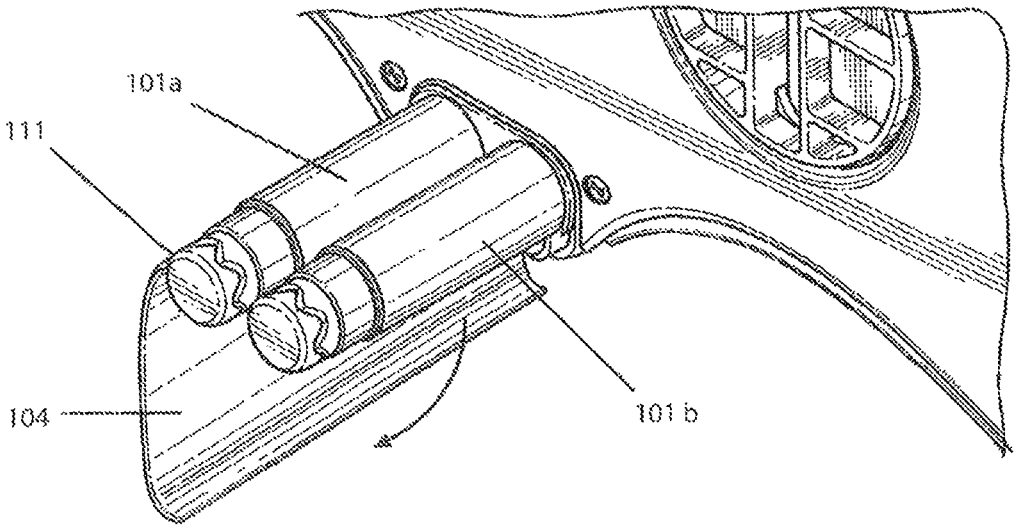
FIG. 6 illustrates an embodiment of a fragmentary view of an exemplary bidet washing apparatus illustrating a shield gate protecting the nozzle assembly in an open position.

Referring to FIGS. 5-6, the protective shield gate 104 can be movable along a hinged edge 111 to provide for further hygiene. The protective shield gate 104 rotates and thus can be manual, for example, opened (FIG. 6) and closed (FIG. 5), after using the toilet to clean any minute leftover pollutants on the outer covering of the nozzle assembly to ensure complete cleanliness. In the embodiment, the user can open and close the gate manually and, thus, the gate can stay in the opened or closed position that the user places the gate. In certain embodiments, the gate can be opened and dosed by an electrical signal using a control switch located on the control unit 108, which can allow the gate to remain open until the user closes the gate via the control switch, so the user can clean the nozzle. In other embodiments, the hinged edge 111 is on the top of the protective shield gate 104, and not, on the side edge as shown in the illustrative FIGS. 5-6. hi. yet other embodiments, the user may be able to completely remove the protective shield gate 104 for cleaning the nozzle(s) and reattach it after cleaning. Of course, one of ordinary skill in the art would understand that the hinged edge could comprise any rotatable joint mechanism that allows for, the rotation of the protective shield gate 104 to provide efficient access to the nozzle(s). If the protective shield gate 104 is completely removable, a grooved and slidable mechanism can be employed so that the protective shield gate 104 can slide in and out to be attached and removed. Of course, other mechanisms can be utilized for removably attaching the protective shield gate 104, e.g., a magnet or a snap structure.

In certain embodiments, the protective shield gate 104 has a flap portion perpendicular to the protective shield gate 104 such that it covers the bottom of the nozzle assembly 101. Additionally, the flap can have a spring mechanism such that it is pushed out and aligns with the protective shield gate 104 by the force of the water stream when water flows out of the nozzle assembly 101. When the water flow stops, the flap can spring hack into its original position perpendicular to the shield gate 101.

The protective shield gate 104 of the disclosure can be made from a material selected from plastic, metal, a material having anti-microbial properties, and material with increased pollutant repellant properties.

In certain embodiments, the angle of the washing nozzles can be adjusted using a control switch located on the control unit 108. Thus, when a user wants to clean certain body parts, water can be sprayed on the desired body part by adjusting the angle of the washing nozzle(s). As shown in FIG. 3, the height of the protective shield gate is such that it allows for an uninterrupted spray of water from the nozzle assembly 101, since the nozzle assembly 101 can extend beyond the bottom edge of the protective shield gate 104.

Figure 4:
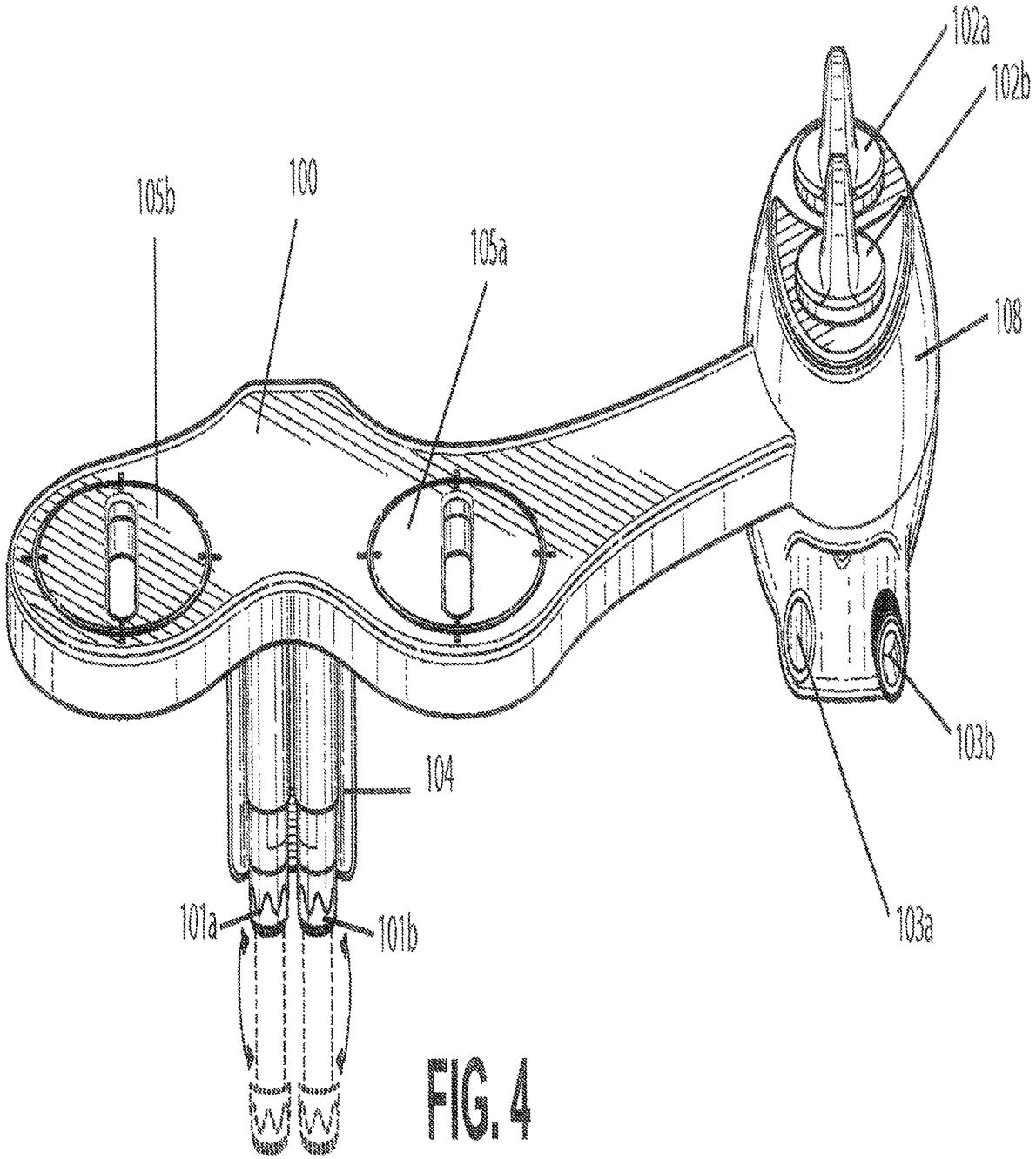
FIG. 4 illustrates an embodiment of a perspective view of an exemplary bidet washing apparatus, with dotted lines showing nozzles extended outwards.

FIG. 4 shows another embodiment wherein the height of the protective shield gate is equal to or greater than that of the washing nozzles 101*a* and 101*b*. Here, the washing nozzles 101*a* and 101*b* are housed within an outer covering including a spring mechanism for pushing the washing nozzles out when water flows through the washing nozzles such that the water flow is not interrupted by the protective shield gate 104. Each washing nozzle includes an outer covering and an inner nozzle operated slidably hack and firth with hydraulic pressure of the supplied washing water by an instruction from the control unit 108. During the use of the washing nozzles, the nozzles are extended from their outer covering below the length of the shield gate by the hydraulic force of the washing water, and water is sprayed on the user for cleaning purposes. After use, when the water flow is stopped, the nozzles are retracted in their outer covering which is hidden behind the shield gate. In certain other embodiments, the user may control the movement of the washing nozzle by using the control unit 108, instead of the hydraulic pressure. When an instruction of a washing operation is given by the control unit 108, a washing nozzle driving unit is activated to advance the nozzle. The washing nozzle angle can also be adjusted by an instruction given by the control unit 108 to position the nozzle for cleaning. Thus, the washing nozzle can reach the user's desired washing position by the combined advancement of the nozzle and/or the angular positioning.

According to the embodiment, nozzle assembly 101 includes at least one washing nozzle in yet another embodiment, the bidet washing apparatus 100 further includes a self-cleaning nozzle for cleaning the nozzle assembly itself. The self-cleaning nozzle can be positioned to spray water onto the nozzle assembly 101 and/or washing nozzle(s) before and/or after the usage for additional hygiene. The self-cleaning nozzle can be adapted to be controlled by the control unit 108, and thus provides an additional hygiene level.

Another embodiment includes a toilet cleaning nozzle for cleaning the toilet and the bidet before and after use of the toilet. The toilet cleaning nozzle can be positioned to spray water on the toilet bowl 110 and/or the bidet washing apparatus 100 and can be controlled by the control unit to provide additional hygiene. Yet, another embodiment includes a shield cleaning nozzle for cleaning the protective shield gate 104. The shield cleaning nozzle can be similarly controlled by the control unit 108. Additionally, the shield cleaning nozzle can be positioned to clean the protective shield gate 104 in an open and/or closed position.

Any or all of the washing nozzles can be connected to the nozzle assembly 101 via a ball joint, for example. which could allow the user to manually swivel a washing nozzle around 360 degrees, to direct the spray of water in a desired and precise direction. Of course, other types of joints and connectors could be implemented to allow for the manual swivel or direction correction, as desired by the user to spray water to the desired body part, for example.

Moreover, according to an exemplary embodiment, one or more of the washing nozzle(s) 101*a* and 101*b* can be connected to the nozzle assembly 101 by a mechanism allowing for the easy removal of the nozzle(s) 101*a* and 101*b*. For example, the washing nozzle(s) 101*a* and 101*b* can slide into place via a grooved portion of the nozzle assembly 101 or could otherwise snap into place. Any conventional mechanism of removably attaching the nozzle (s) 101*a* and 101*b* can be implemented, so that the user can swap the nozzle(s) 101*a* and 101*b* with other nozzles or increase or reduce the number of washing nozzle(s) 101*a* and 101*b* connected to the nozzle assembly 101.

Figure 7:
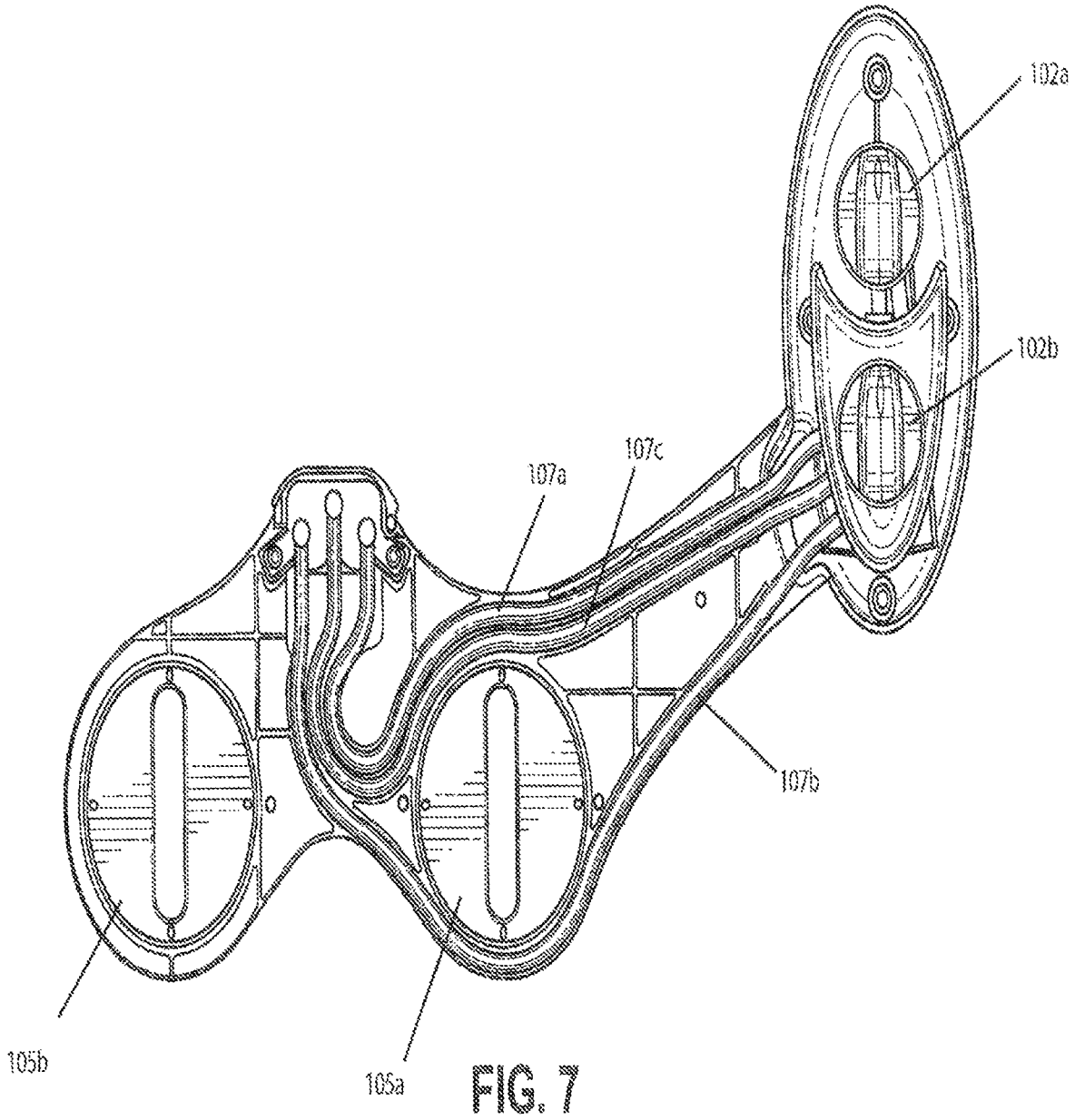
FIG. 7 illustrates an embodiment of a top plan view of an exemplary embodiment.
Figure 8:
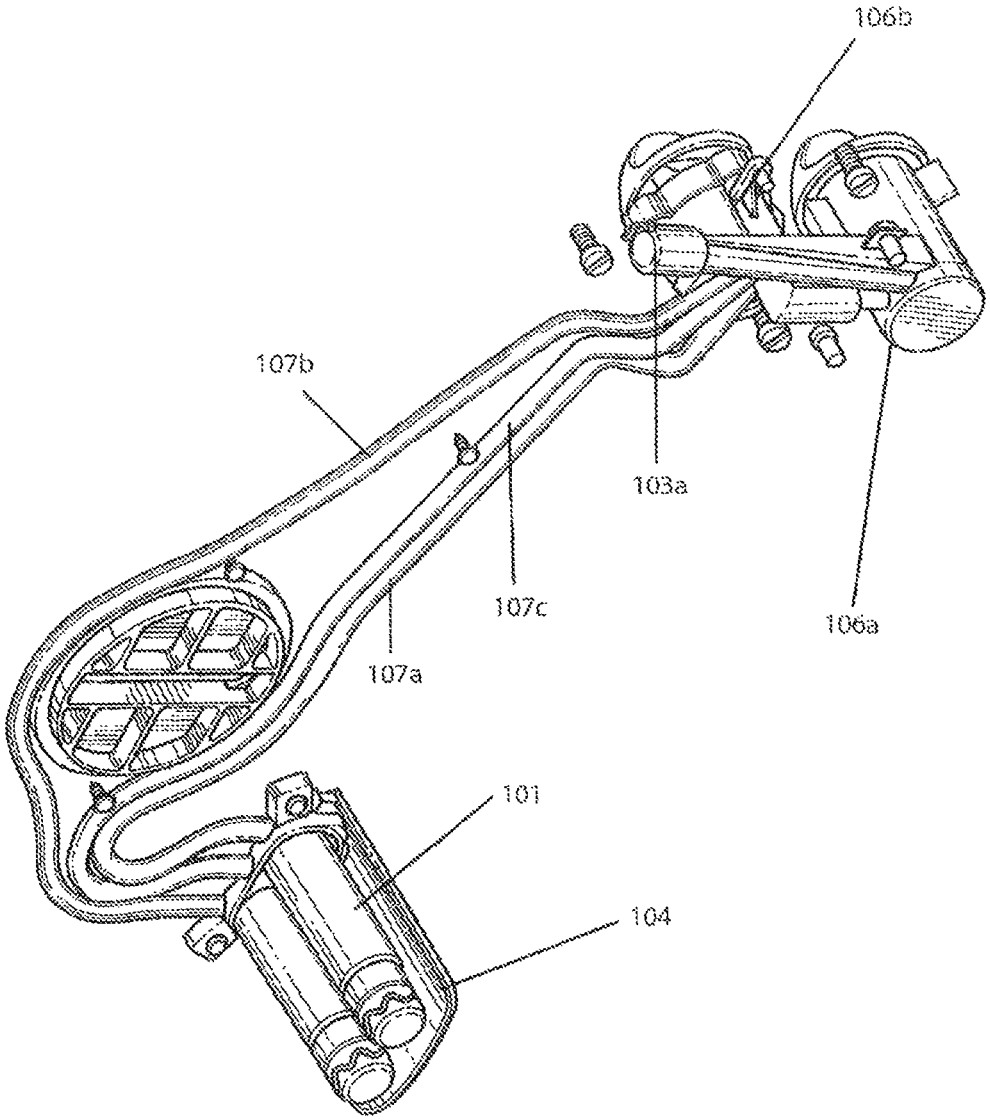
FIG. 8 illustrates an embodiment of a bottom plan view of a perspective view of a bidet washing apparatus.

An exemplary water supply system to the nozzle assembly 101 will be detailed hereinafter concerning FIGS. 7-8. The control unit 108 can house the control valves 106*a* and 106*b* (as shown in FIG. 8), to control the flow of water to the water tubes and has the control switches 102*a* and 102*b*, for giving instructions to the control valves. Two control valves and control switches are depicted for exemplary purposes, but it should be understood that any number of control valves and corresponding switches can be employed.

The control valves 106*a* and 106*b* can be situated at the entrance to the water tubes 107*a*, 107*b*, and 107*c* in this example. The control valves 106*a* and 106*b* are designed to open, close, or partially obstruct the water inlet 103*a* opening into the water tubes 107*a*, 107*b*, and 107*c*, such that the volume of the water flowing through any tube at any given time can be easily controlled by the user by giving simple instructions through the control switches. The water tubes 107*a*, 107*b*, and 107*c* connect the control valves 106*a* and 106*b* at one end to the nozzle assembly 101 at the other end. Thus, the control valves 106*a* and 106*b* can effectively control the volume of water flowing to the nozzle assembly 101. In the embodiment, one water tube 107*b* passes through the back of the bidet washing apparatus 100, and two water tubes 107*a* and 107*c* pass through the front of the bidet washing apparatus 100. However, it is to be noted that in an embodiment, more than one water tube could pass through the back of the bidet washing apparatus 100, and the number of water tubes passing through the front of the bidet washing apparatus 100 could be more or less than two.

According to an embodiment, the bidet washing apparatus 100 can include a vacuum breaker (not depicted), which can be situated at various locations within the bidet washing apparatus 100. The vacuum breaker can be located anywhere between the water supply (e.g., the water tank supplying water to the toilet bowl) and the washing nozzle(s) e.g., 101*a* and 101*b*) output. The vacuum breaker can be intended to halt the flow of water that is not expelled by the washing nozzle(s) back into the water supply. According to one exemplary embodiment, the vacuum breaker(s) can be housed within the control unit 108, located between a valve 106*a* and 106*b* and the nozzle assembly 101; however, one of ordinary skill in the art would realize that various locations of one or more vacuum breakers can be implemented within the scope of this disclosure to perform the desired function.

In some embodiments, a bidet washing apparatus is provided that includes a mechanism for delivering an aliquot of a liquid deodorizing solution, a liquid antibacterial and/or a liquid antiseptic solution into a toilet bowl or combinations thereof. For example, a user may dispense a spray, a mist, or one or two drops from the mechanism into the bowl before use. The deodorizing solution forms a thin film on top of the surface of the water that traps and eliminates embarrassing odors before they escape into the air. In addition, as matter enters the toilet bowl water, it is coated with the deodorizing solution thereby eliminating odor.

Common ingredients for a liquid deodorizing solution includes but are not limited to essential oils, alcohols, and water. In other embodiments, the liquid deodorizing solution includes one or more cleaners, for example, alkalis, acids, detergents, abrasives, sanitizers, and spirit solvents.

Useful essential oils include but are not limited to lavender (*Lavandula officinalis*), rosemary (*Rosmarinus officinalis*), tea tree (*melaleuca alternifolia*), lemon (*citrus limonum*), peppermint (*Mentha piperita*), *eucalyptus* (*eucalyptus globulus, eucalyptus sideroxylon* and *eucalyptus* torquate), clove (syzgium *aromaticum*), chamomile (*anthemis nobilis*), frankincense (*boswellia carterii*), myrrh (*commiphora* myrrha), grapefruit (*citrus paradisi*), oregano (*Origanum vulgare*), and ginger (*Zingiber officinale*), *hamamelis virginiana* extract, *rosa* damascene flower oil, *Lavandula angustifolia* oil, aloe *barbadensis* leaf extract, *mentha arvensis* leaf oil, *Sophora japonica* flower extract, and combinations thereof.

Useful alcohols include but are not limited to C1-C6 alcohols, for example, methanol, ethanol, propanol, isopropanol, and the like) and combinations thereof. Other ingredients include but are not limited to plant extracts, antimicrobial organic salts, essential oil solubilizer, emulsifier, surfactant, and water and combinations thereof.

Figure 10:
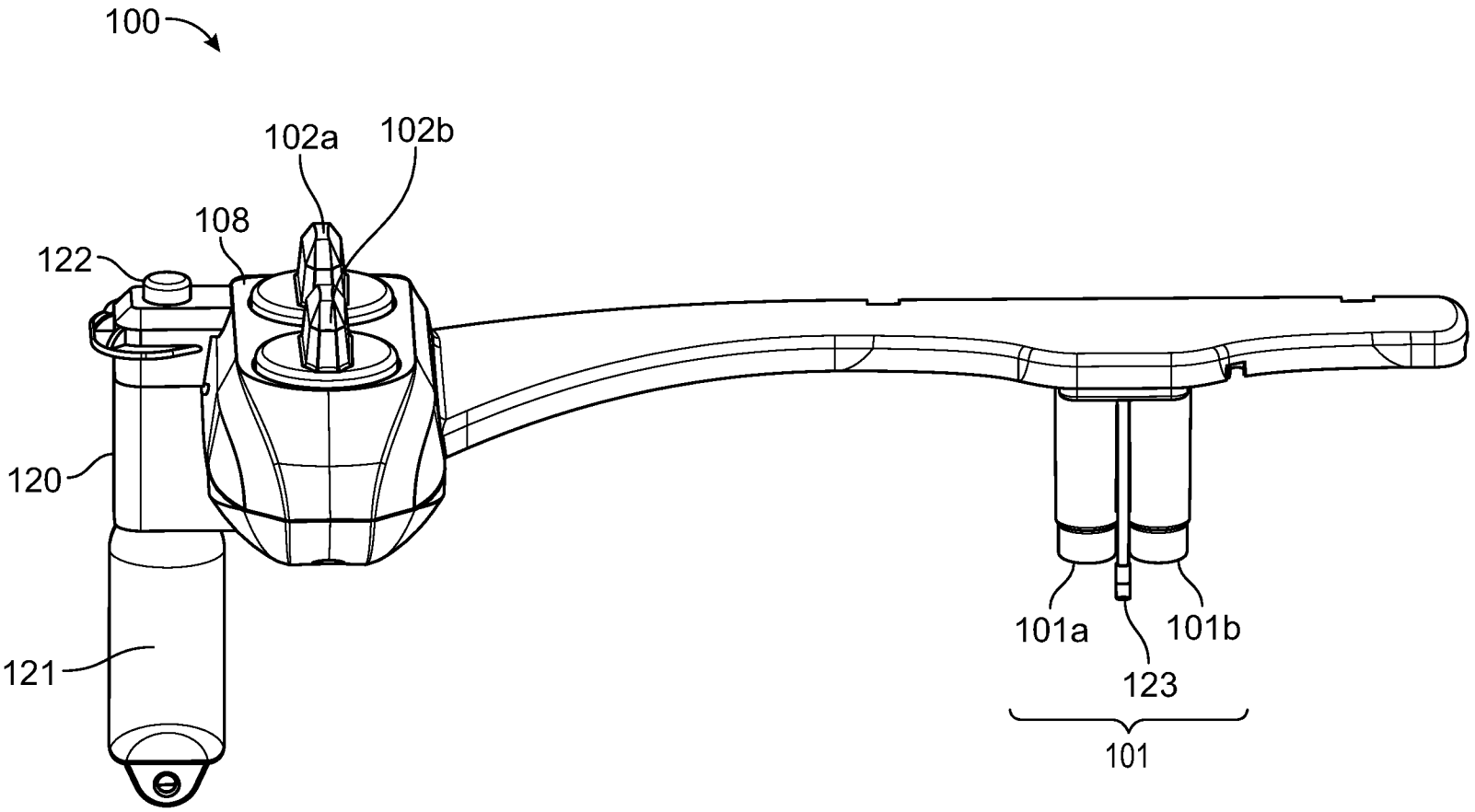
FIG. 10 illustrates an embodiment of a front top view of a bidet washing apparatus with a deodorizer housing unit, deodorizer container and deodorizer actuator.

FIG. 10 illustrates an embodiment of a front top view of a bidet washing apparatus 100, which includes a deodorizer housing unit 120, a container 121, and a deodorizer actuator 122. Also shown in this figure is the control unit 108, control switches 102*a* and 102*b*, the nozzle assembly 101, washing nozzles 101*a* and 101*b*. Located in proximity to the washing nozzles is the deodorizer spray or drop outlet 123, which can transfer a liquid deodorizer solution from the deodorizer container into a toilet bowl. In this embodiment, the protective shield gate has been omitted for clarity.

In embodiments, the container 121 can be reversibly or permanently attached to the housing unit 120, for example, by being snapped on, screwed on, or bolted on; or can be permanently attached to the housing unit by being molded or glued thereto or by using any other means known in the art. The housing unit 120 can also be reversibly or permanently attached to the control unit 108 of the bidet washing apparatus 100, for example, by being snapped on, screwed on, bolted on; or permanently attached to the control unit by being molded or glued thereto or by using any other means known in the art.

In other embodiments, the housing unit 120, container 121, and deodorizer actuator can be directly incorporated into the control unit 108 of the bidet washing apparatus 100 as shown below. For both configurations, when the actuator is engaged, e.g., by manually pushing the actuator down, a pump is actuated and an aliquot of the liquid deodorizer solution present in the deodorizer container can be delivered by spray, mist, or drop into a toilet bowl.

As used herein, an "actuator" includes but is not limited to a push-button, twist-button, pull up and push down button, a slide button, a plunger button, a lever, a knob, or other similar devices.

Figure 11:
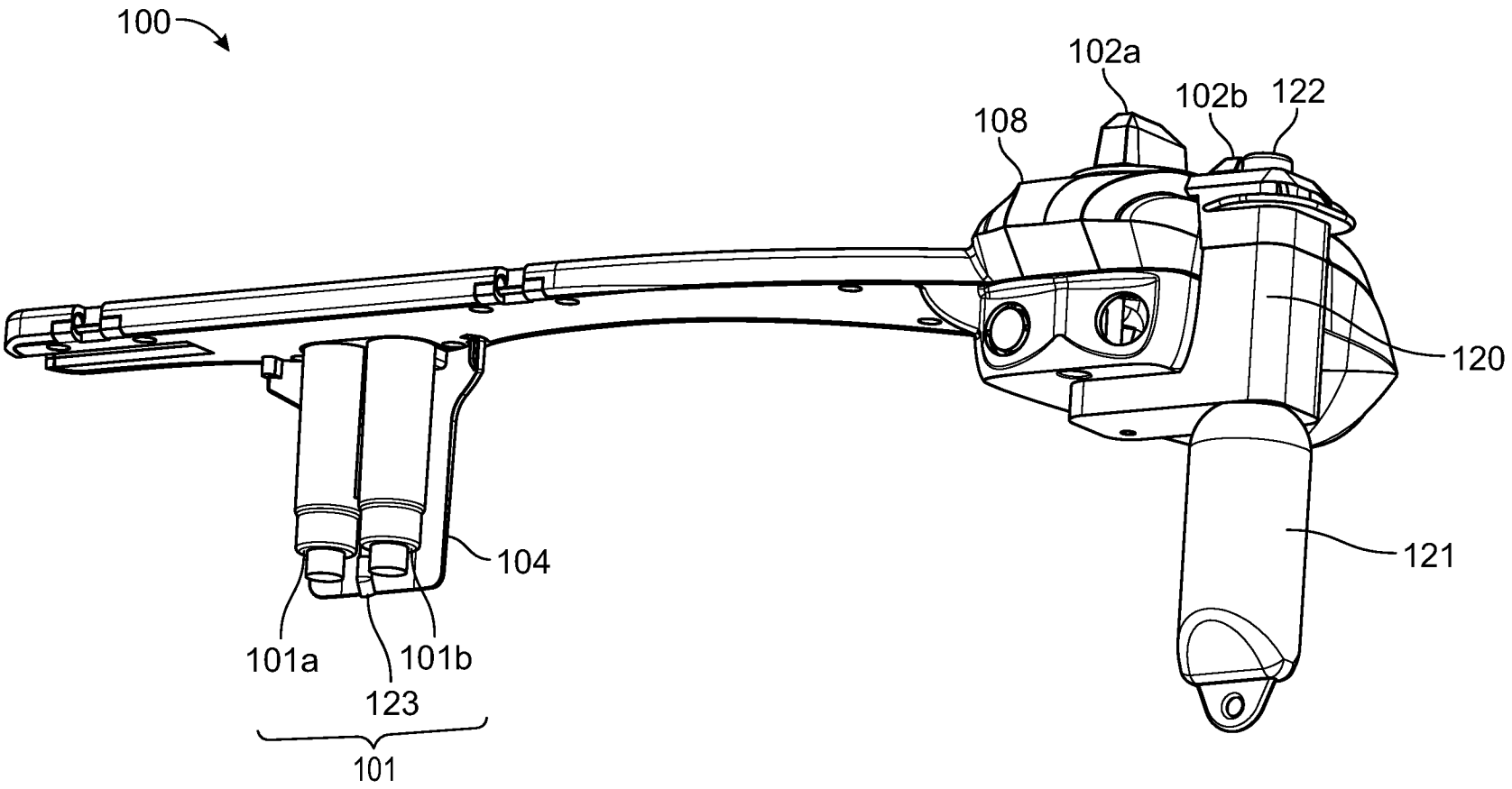
FIG. 11 illustrates an embodiment of a rear bottom view of a bidet washing apparatus with a deodorizer housing unit, deodorizer container and deodorizer actuator.

FIG. 11 illustrates an embodiment of a rear bottom view of a bidet washing apparatus 100, which includes a housing unit 120, a deodorizer container 121, and an actuator 122 attached thereto. Also shown is the control unit 108, control switches 102*a* and 102*b*, water inlets 103*a* and 103*b*, the nozzle assembly 101 including wash nozzles 101*a* and 101*b*, the protective shield gate 104, and the deodorizer spray or drop outlet 123.

Figure 12:
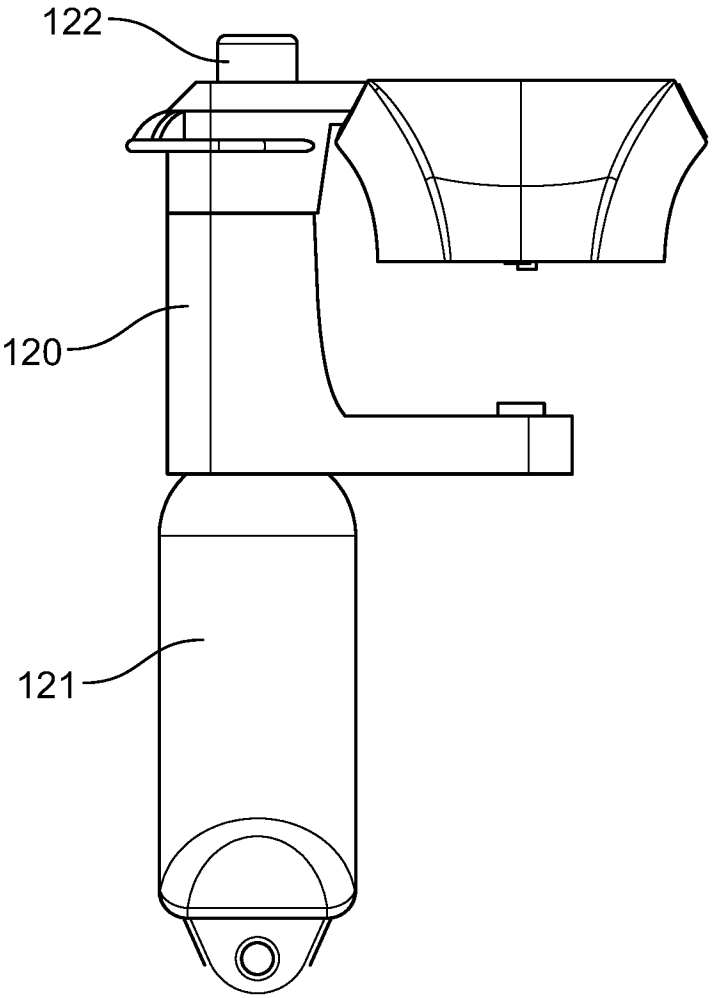
FIG. 12 illustrates an embodiment of a front cut-away view of a deodorizing housing unit, deodorizer container and deodorizer actuator.

FIG. 12 illustrates an embodiment of a front cut-away view of the housing unit 120 (without the control unit shown for simplicity). As shown, the bidet housing unit includes the container 121 and the actuator 122 attached thereto.

Figure 13:
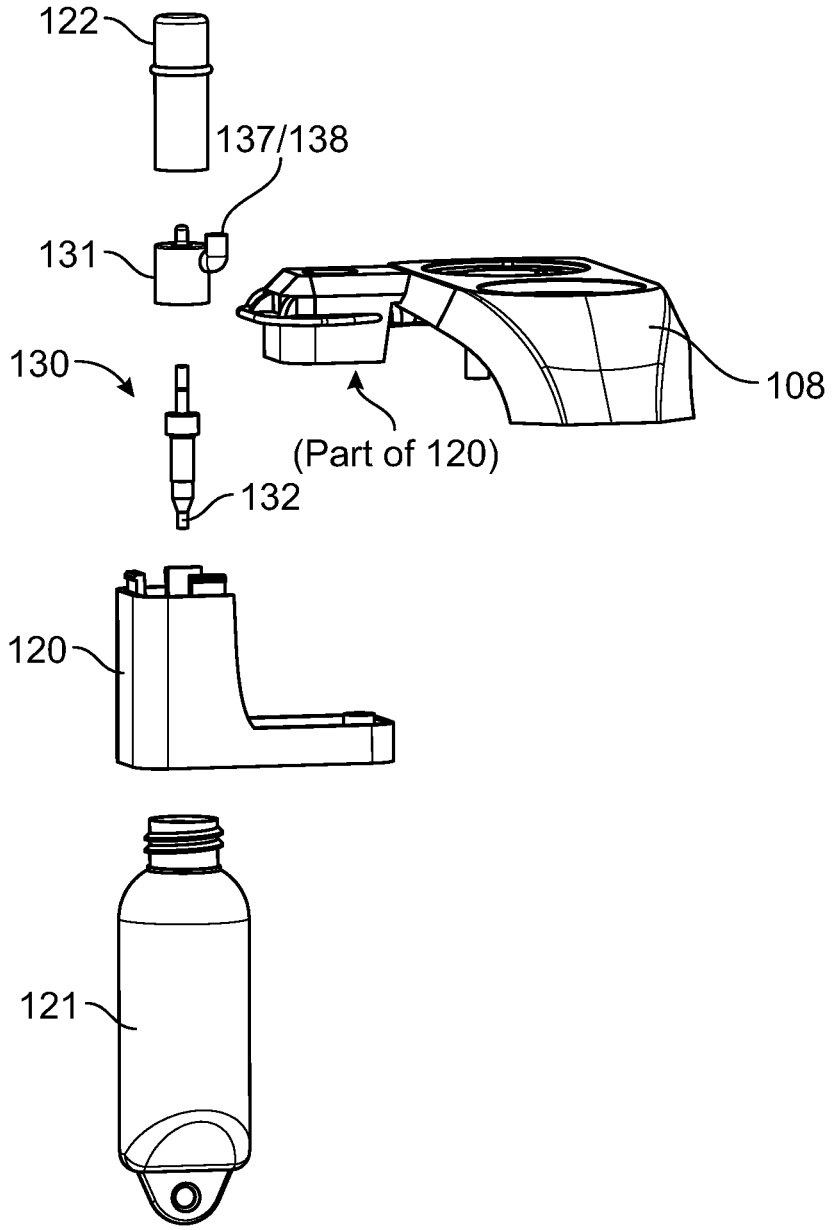
FIG. 13 illustrates an embodiment of a front exploded view of the housing unit, container, actuator, and a pump

FIG. 13 illustrates an embodiment of a front exploded view of the housing unit 120, the container 121, the actuator 122, and a pump 130 including a pump chamber 131, a pump inlet tube 132, and a pump outlet tube 137 and pump outlet tube opening 138, and control unit 108.

Figure 14:
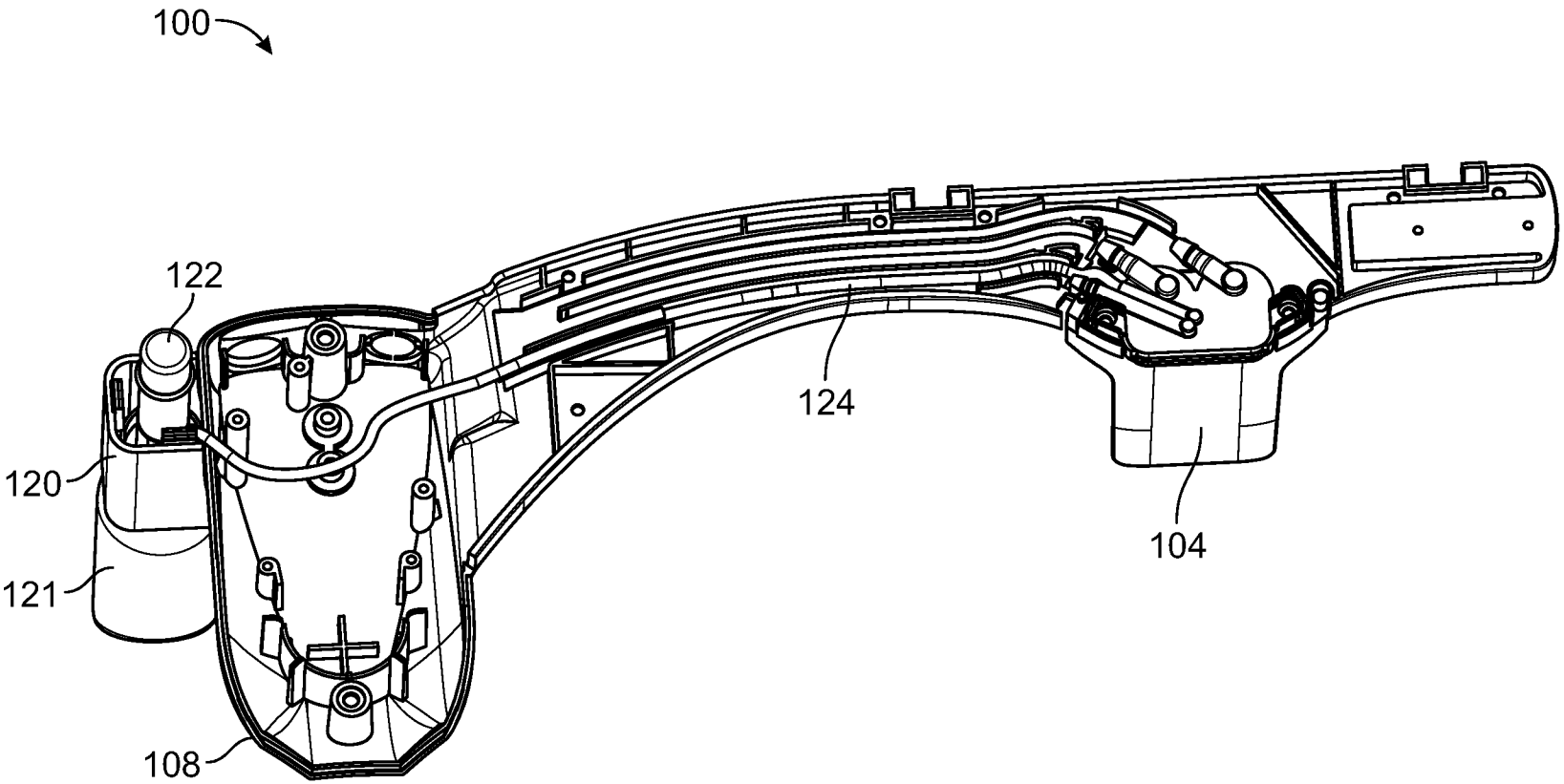
FIG. 14 illustrates an embodiment of a front cut-away view of a bidet washing apparatus with a deodorizer housing unit, deodorizer container and deodorizer actuator.

FIG. 14 illustrates an embodiment of a front cut-away view of a bidet washing apparatus 100, which includes a housing unit 120, a container 121, and an actuator 122 attached thereto. Also shown is the protective shield gate 104, and the deodorizer spray or drop outlet 123. As shown, a deodorizer tube 123 124 runs from the housing unit 120 to the nozzle assembly 101. The deodorizer tube 123 124 can run across the bidet washing apparatus 100 along a similar path as water tubes 107*a*, 107*b*, and 107*c* to the nozzle assembly 101 and into the deodorizer spray or drop outlet 123. In embodiments, when the actuator is engaged, e.g., by manually pushing the actuator down, a pump in the deodorizer housing unit 101 is actuated and an aliquot of the liquid deodorizer solution present in the container 121 can be delivered through the pump outlet 137 in the housing unit 120 through the deodorizer tube 124 and to the deodorizer spray or drop outlet 123 for delivery into a toilet bowl. In some embodiments, the pump is a bottle pump. In other embodiments, an aerosol spray device can be configured to deliver a deodorizer solution.

Figure 15:
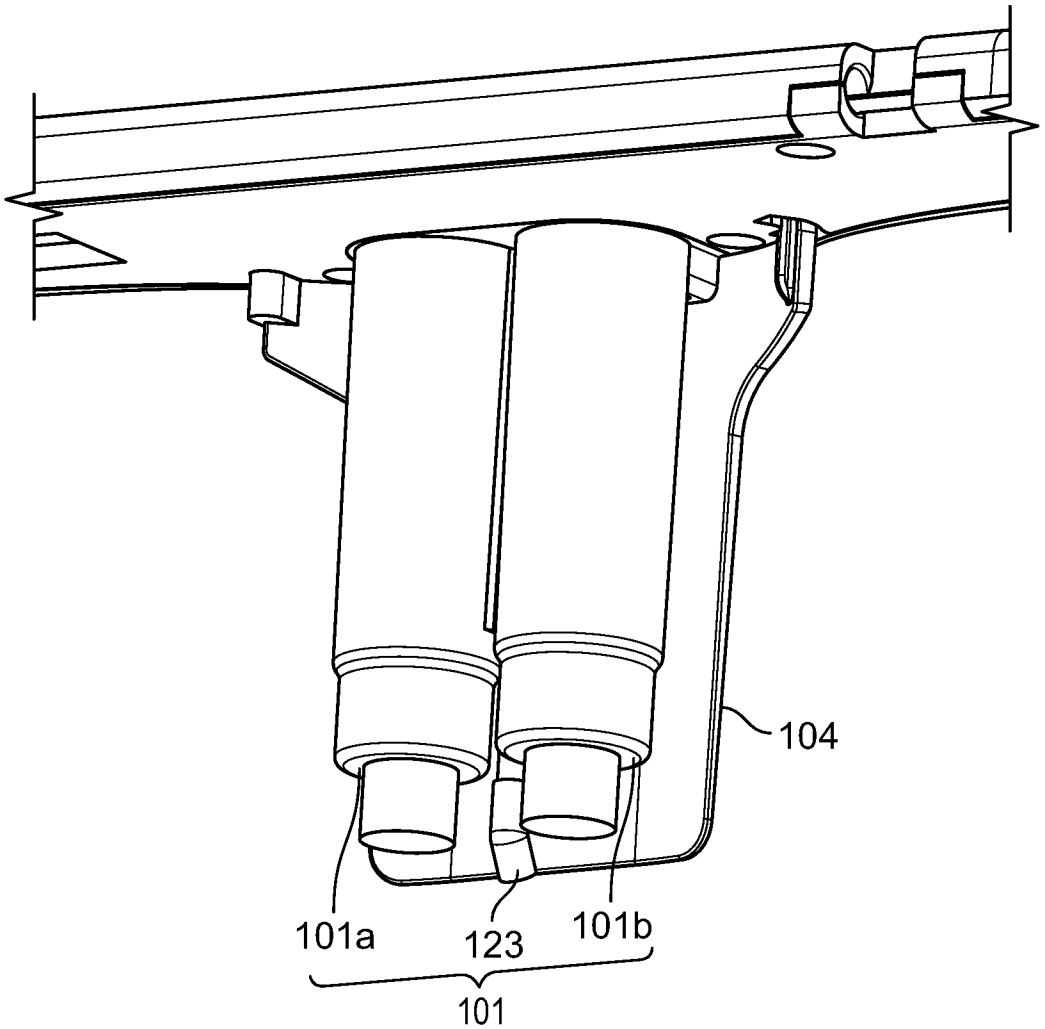
FIG. 15 illustrates an embodiment of a rear cut-away view of a nozzle assembly, which includes the washing nozzles, the protective shield gate, and the deodorizer spray or drop outlet.

FIG. 15 illustrates an embodiment of a rear cut-away view of a nozzle assembly 101, which includes the washing nozzles 101*a* and 101*b*, the protective shield gate 104, and the deodorizer spray or drop outlet 123. In embodiments, the deodorizer spray or drop outlet can be located behind the protective shield gate. In other embodiments, the deodorizer spray or drop outlet can be incorporated above or in front of the protective shield gate.

Figure 16:
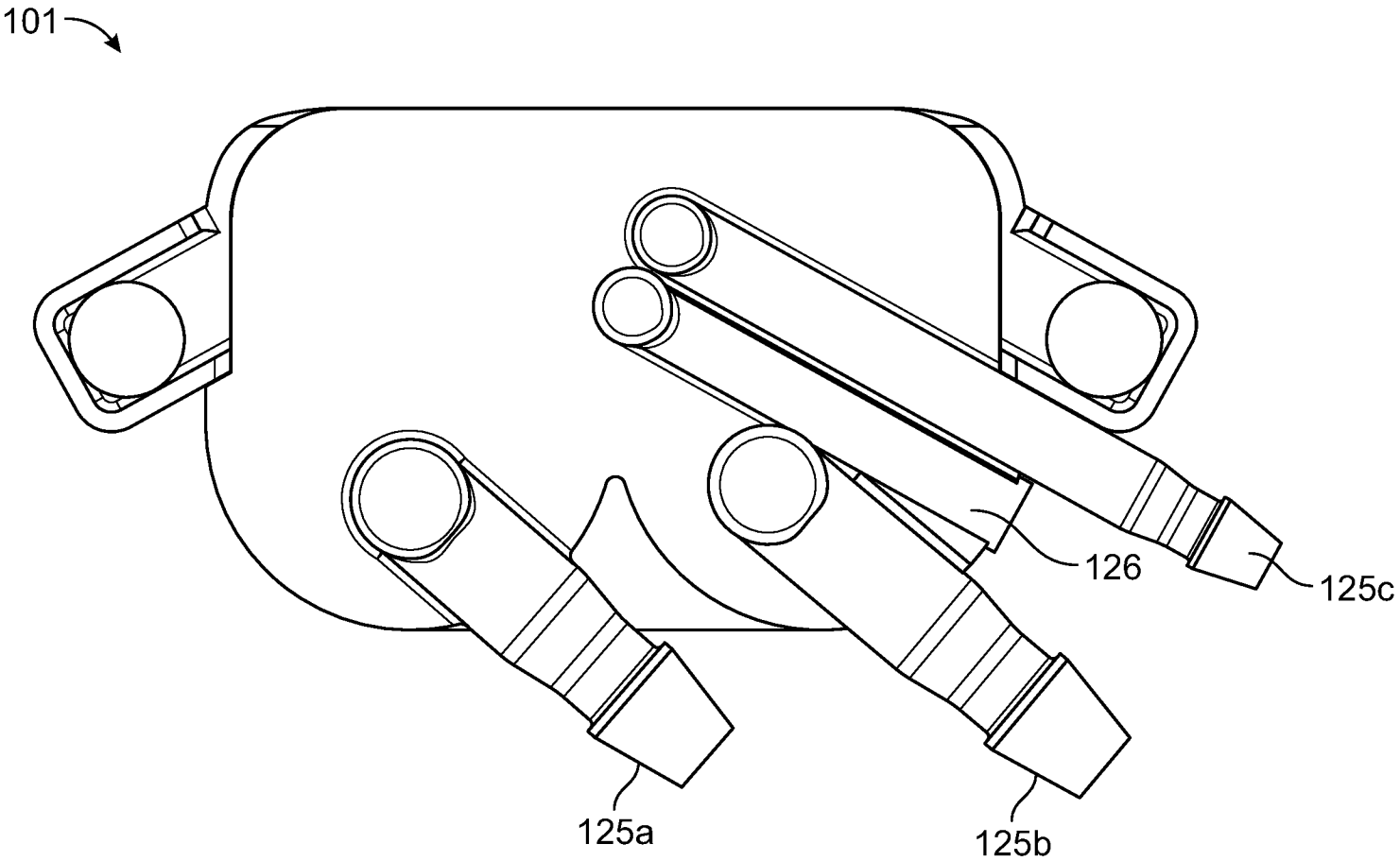
FIG. 16 illustrates an embodiment of a top cut-away view of the nozzle assembly including three inlets, three water tubes, washing nozzles, a deodorizer inlet, deodorizer tube, and a deodorizer spray or drop outlet.

FIG. 16 illustrates an embodiment of a top cut-away view of the nozzle assembly 101, which includes inlets 125*a*, 125*b*, and 125*c* for connecting water tubes to the washing nozzles; and deodorizer inlet 126 for connecting deodorizer tube to the deodorizer spray or drop outlet.

Figure 17:
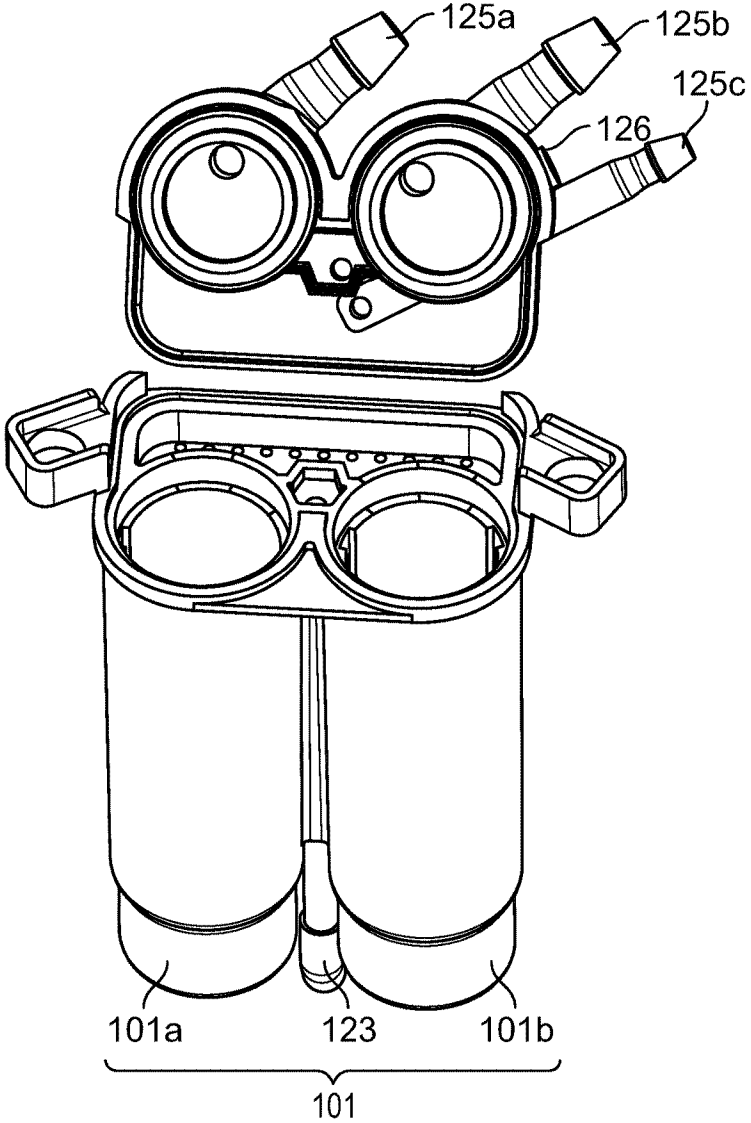
FIG. 17 illustrates an embodiment of an exploded, top cut-away view of the nozzle assembly including three inlets, three water tubes, washing nozzles of the nozzle assembly, deodorizer inlet 126, deodorizer tube, and a deodorizer spray or drop outlet.

FIG. 17 illustrates an embodiment of an exploded, top cut-away view of the nozzle assembly 101, which includes inlets 125*a*, 125*b*, and 125*c* for connecting water tubes to the washing nozzles of the nozzle assembly; and deodorizer inlet 126 for connecting the deodorizer tube to the deodorizer spray or drop outlet 123.

Figure 18:
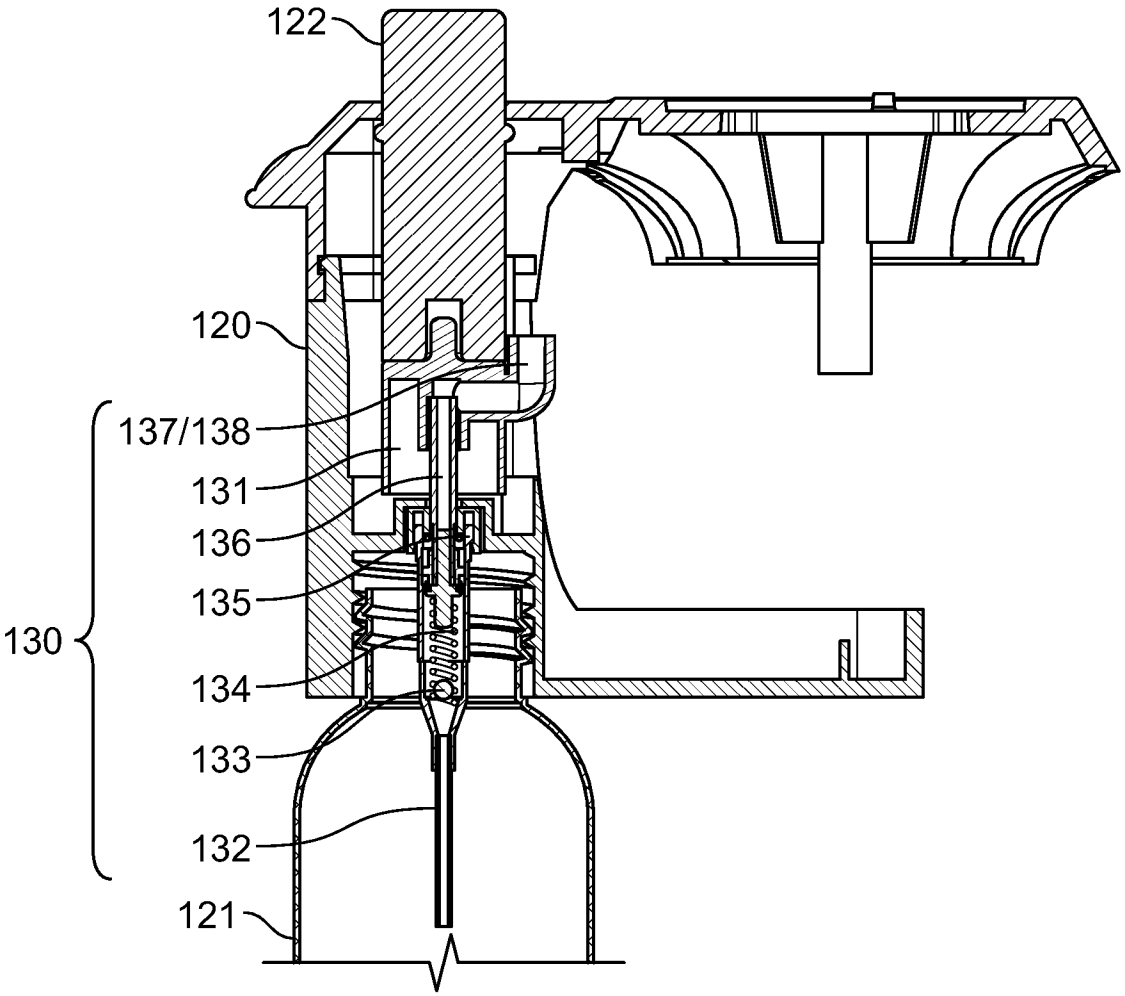
FIG. 18 illustrates an embodiment of a side cut-away view of the deodorizer housing unit, deodorizer container 121, deodorizer actuator, and a pump when in an inactivated position.
Figure 19:
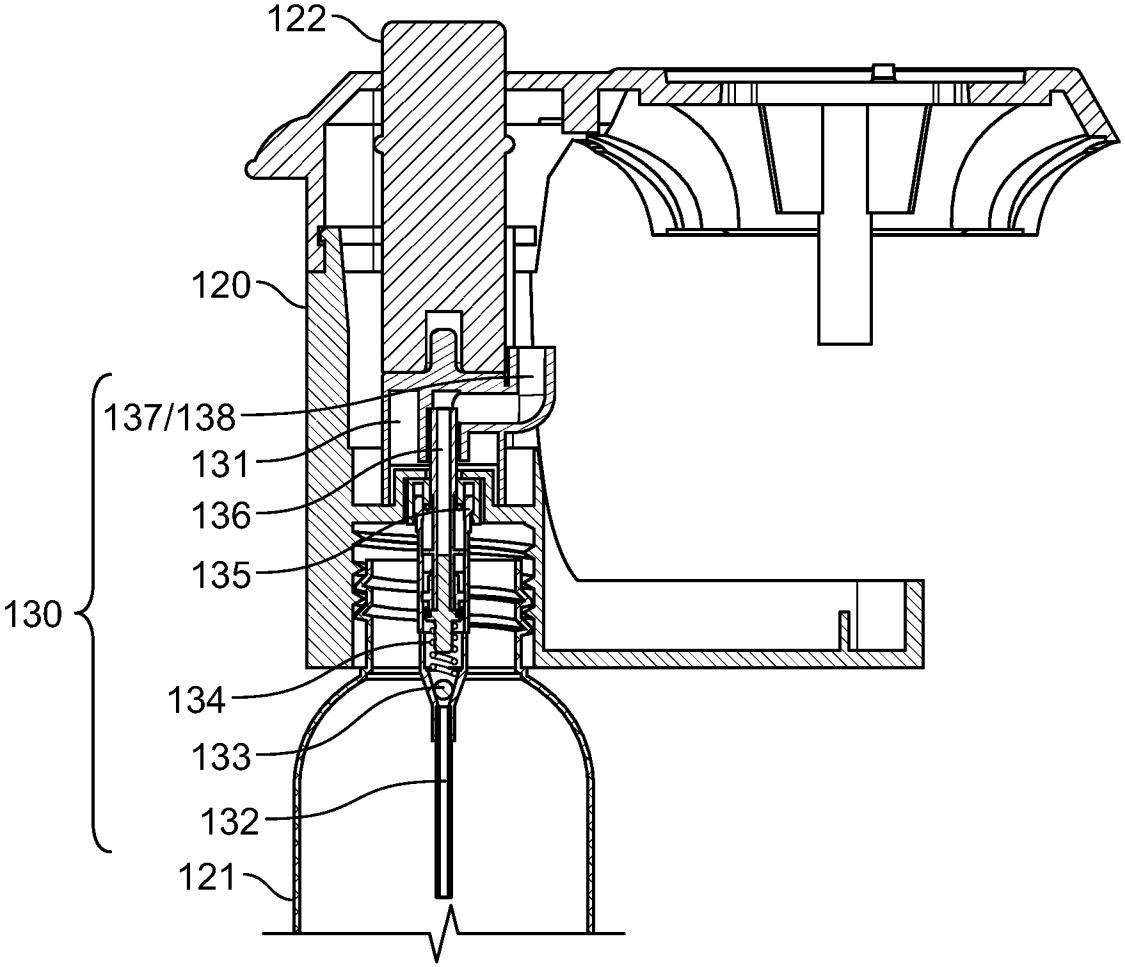
FIG. 19 illustrates an embodiment of a side cut-away view of the deodorizer housing unit, deodorizer container 121, deodorizer actuator, and a pump when in an activated position.

FIGS. 18 and 19 illustrate an embodiment of a side cut-away view of the housing unit 120, which includes the container 121, the actuator 122, and a pump 130 when in an inactivated and an activated position, respectively.

As shown in these figures, the pump 130 can be located within the housing unit 120 near or above the container 121. The pump 130 includes a pump chamber 131, a pump inlet tube 132, a ball 133, a spring 134, a piston 135, a pump barrel 136, and a pump outlet tube 137.

As shown in FIGS. 18 and 19, when the actuator 122 is engaged, e.g., by manually pushing the actuator down, the piston 135 moves down and compresses the spring 134 in the pump barrel 136. The upward air pressure draws the ball 133 upwards along with liquid deodorizer solution in the pump inlet tube 132 and in the container 121 into the pump chamber 131. Releasing the actuator 122 causes the spring 134 to expand returning the piston 135 and actuator 122 to their initial up position and the ball 133 is returned to its resting position. As a result, the ball 133 covers and closes the pump outlet tube opening 138 and the pump inlet tube 132 preventing the liquid deodorizer solution present in the pump chamber 131 from returning to the container 121. Pressing down on the actuator 122 again causes another round of drawing the liquid deodorizer solution in the pump inlet tube 132 and in the container 121 into the pump chamber 131, which causes the liquid deodorizer solution already in the pump chamber 131 to be forced out through the pump outlet tube 137, into the deodorizer tube 124, and eventually into the deodorizer spray or drop outlet (not shown) and the toilet bowl.

Figure 20:
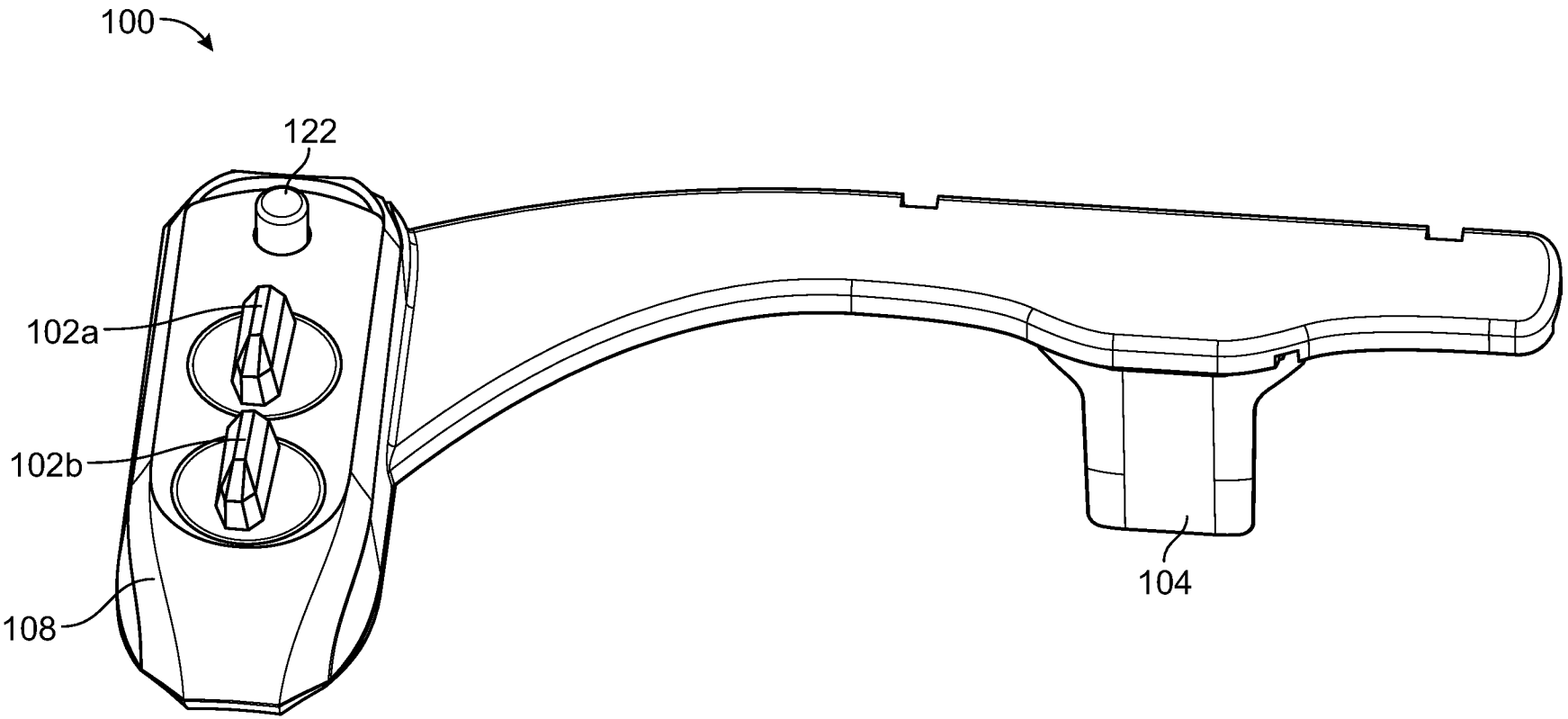
FIG. 20 illustrates an alternative embodiment of a front top view of a bidet washing apparatus, including a deodorizer container and deodorizer actuator incorporated into the control unit of a bidet washing apparatus.

FIG. 20 illustrates an alternative embodiment of a front top view of a bidet washing apparatus 100, in which the container 121 and actuator 122 are incorporated into the control unit 108 of the bidet washing apparatus. As shown, the apparatus also includes the protective shield gate 104, which covers the nozzle assembly 101 and washing nozzles 101*a* and 101*b*.

Figure 21:
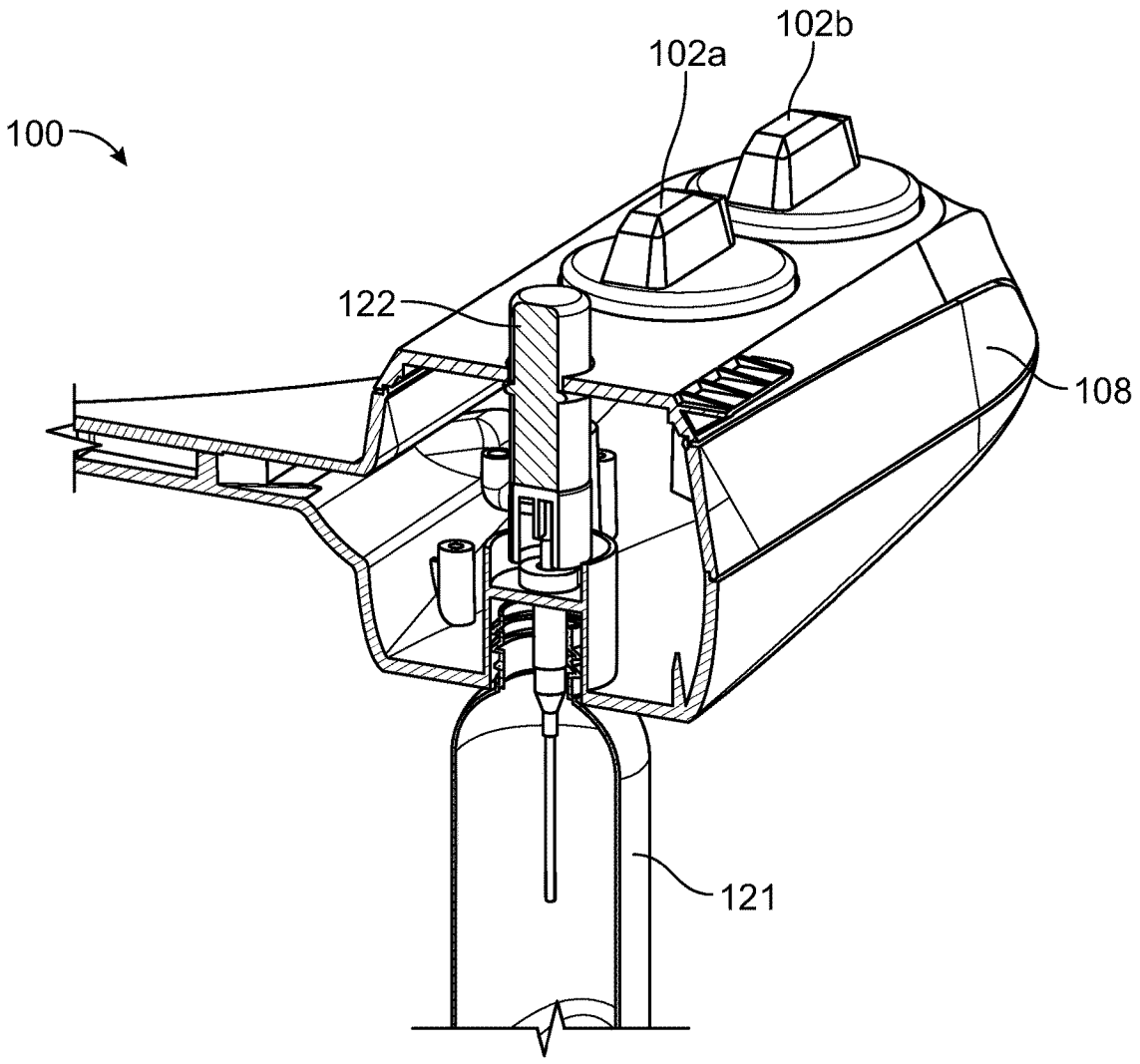
FIG. 21 illustrates an alternative embodiment of a rear top cut-away view of a bidet washing apparatus, including the deodorizer container and deodorizer actuator incorporated into the control unit of the bidet washing apparatus.

FIG. 21 illustrates an alternative embodiment of a rear top cut-away view of a bidet washing apparatus 100, in which the container 121 and actuator 122 are incorporated into the control unit 108 of the bidet washing apparatus.

Figure 22:
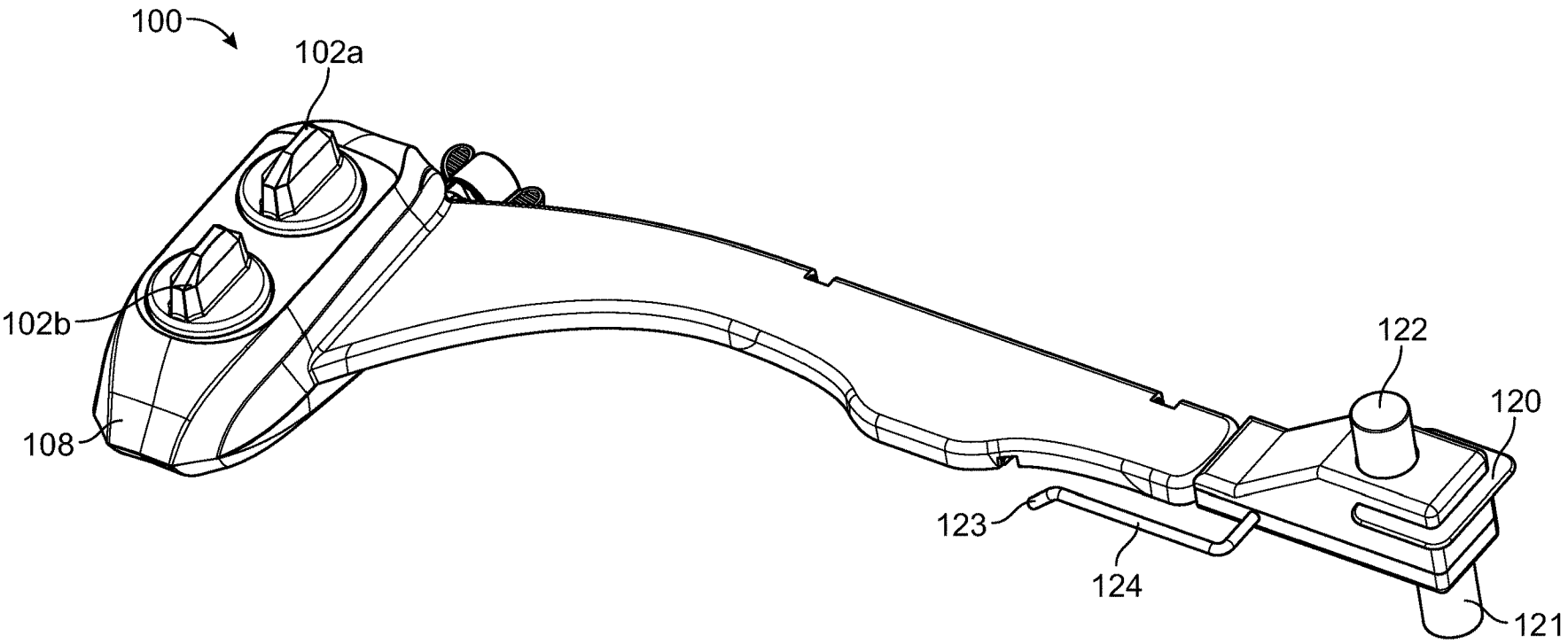
FIG. 22 illustrates another alternate embodiment of a front top view of a bidet washing apparatus, including the deodorizer housing unit, deodorizer container, and the deodorizer actuator incorporated onto the bidet washing apparatus distal to the control unit.

FIG. 22 illustrates another alternate embodiment of a front top view of a bidet washing apparatus 100, in which the housing unit 120, container 121 and the actuator 122 are incorporated onto the apparatus distal to the control unit 108.

Figure 23:
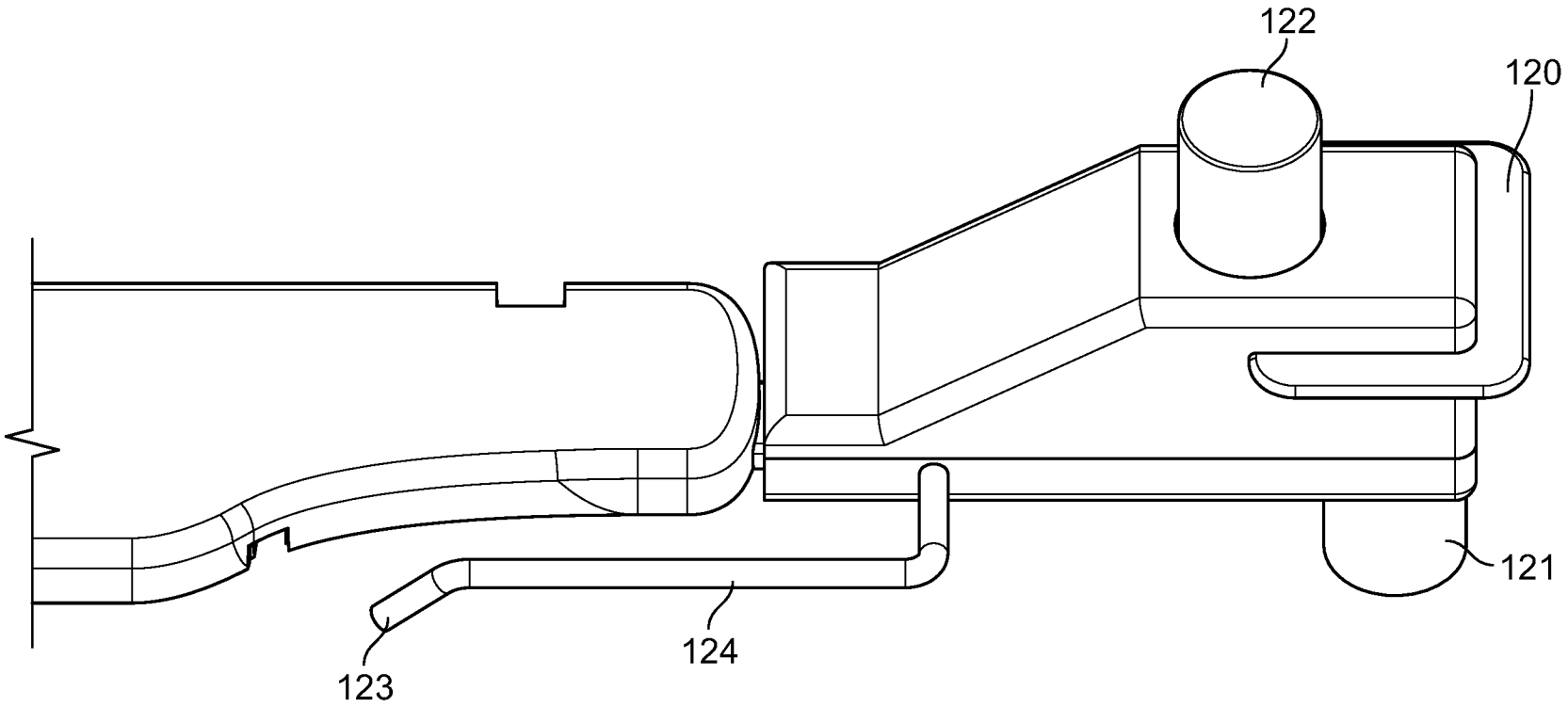
FIG. 23 illustrates another alternate embodiment of a front top view of a bidet washing apparatus, including the deodorizer housing unit, deodorizer container, and the deodorizer actuator incorporated onto the bidet washing apparatus distal to the control unit.

FIG. 23 illustrates another alternate embodiment of a front top view of a bidet washing apparatus 100, in which the housing unit 120, container 121 and the actuator 122 are incorporated onto the apparatus distal to the control unit 108. As shown in this figure, the deodorizer tube 124 extends from the housing unit 120 to the deodorizer spray or droplet outlet 123, which can extend into a toilet bowl for delivery of the liquid deodorizing solution.

Figure 24:
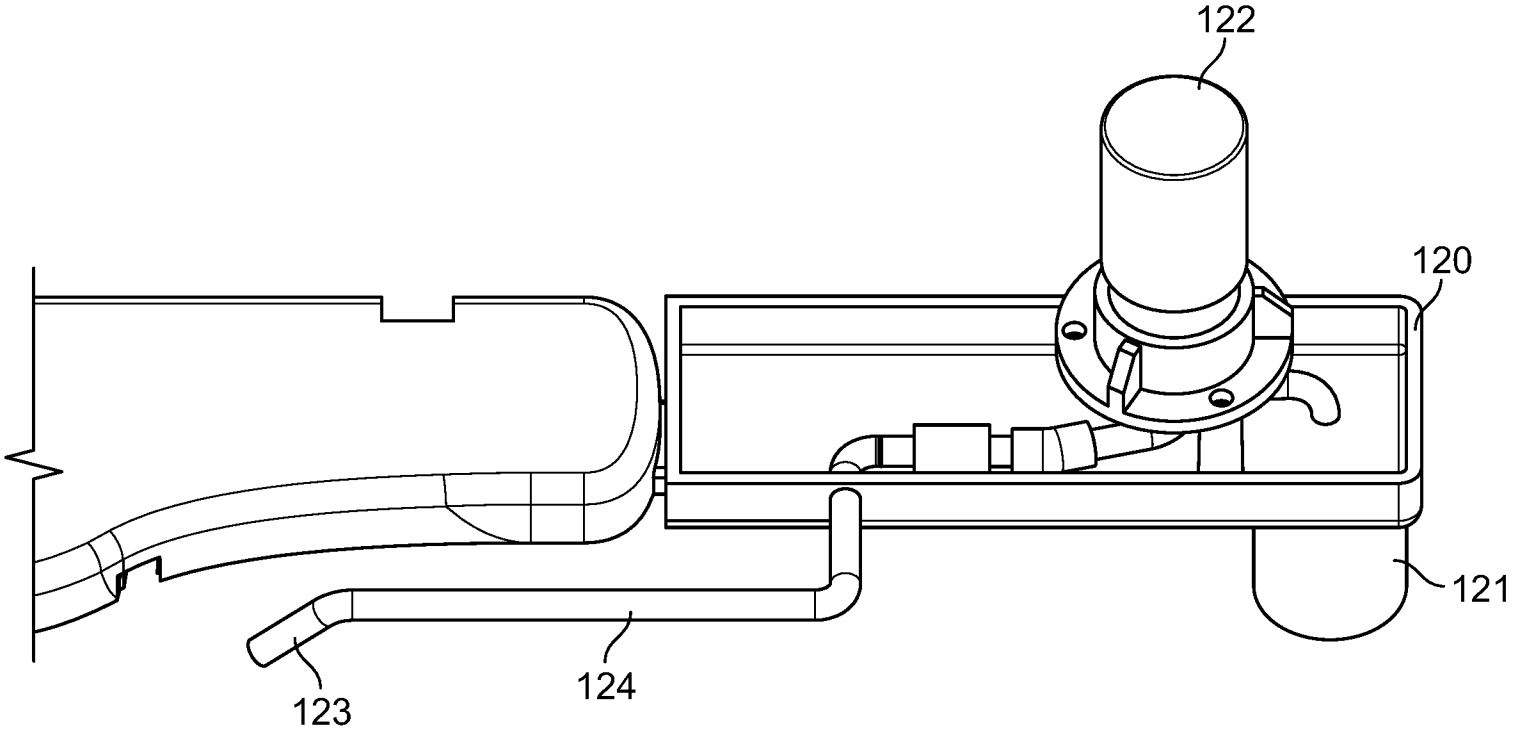
FIG. 24 illustrates another alternate embodiment of a front top cut-away view of a bidet washing apparatus, including the deodorizer housing unit, deodorizer container, and the deodorizer actuator arranged in the control unit.

FIG. 24 illustrates another alternate embodiment of a front top cut-away view of a bidet washing apparatus 100, in which the housing unit 120, container 121 and the actuator 122 are shown as arranged in the control unit 108. As shown in this figure, the deodorizer tube 124 extends from the housing unit 120 to the deodorizer spray or droplet outlet 123, which can extend into a toilet bowl for delivery of the liquid deodorizing solution.

Figure 25A:
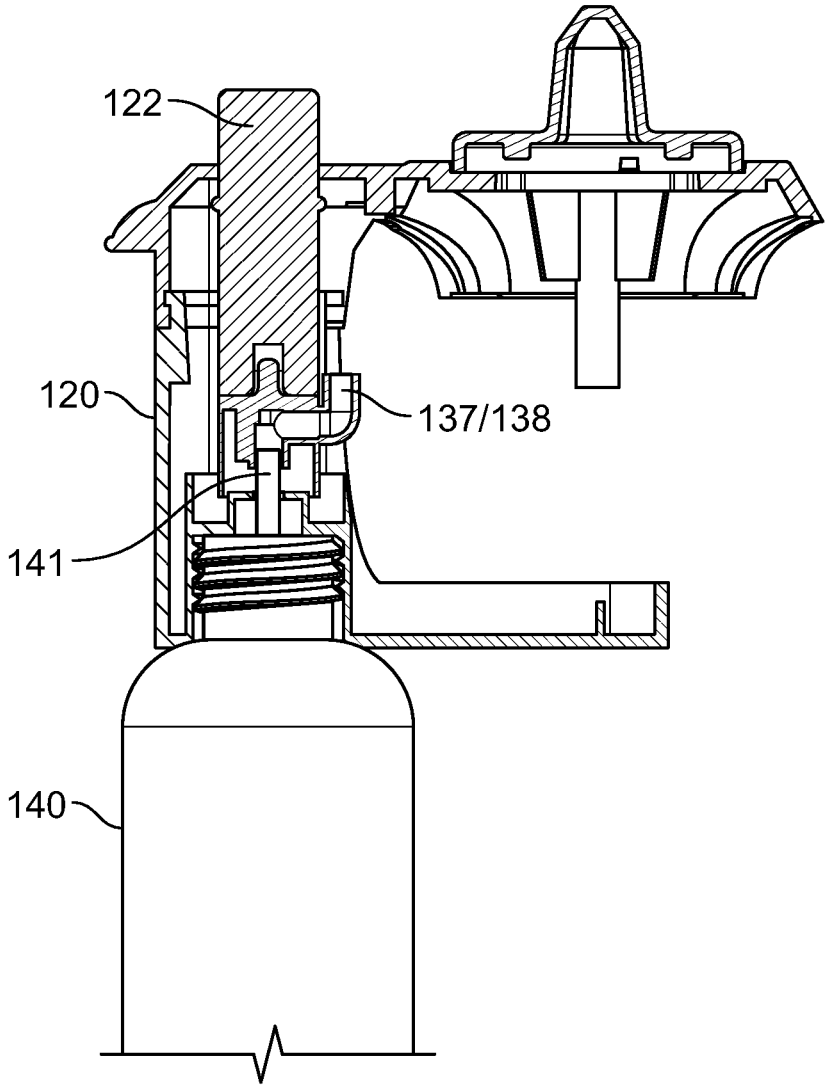
FIG. 25A illustrates an embodiment of a side cut-away view of a deodorizer housing unit, which includes an aerosol container and an actuator configured to deliver a deodorizer solution to a toilet bowl.
Figure 25B:
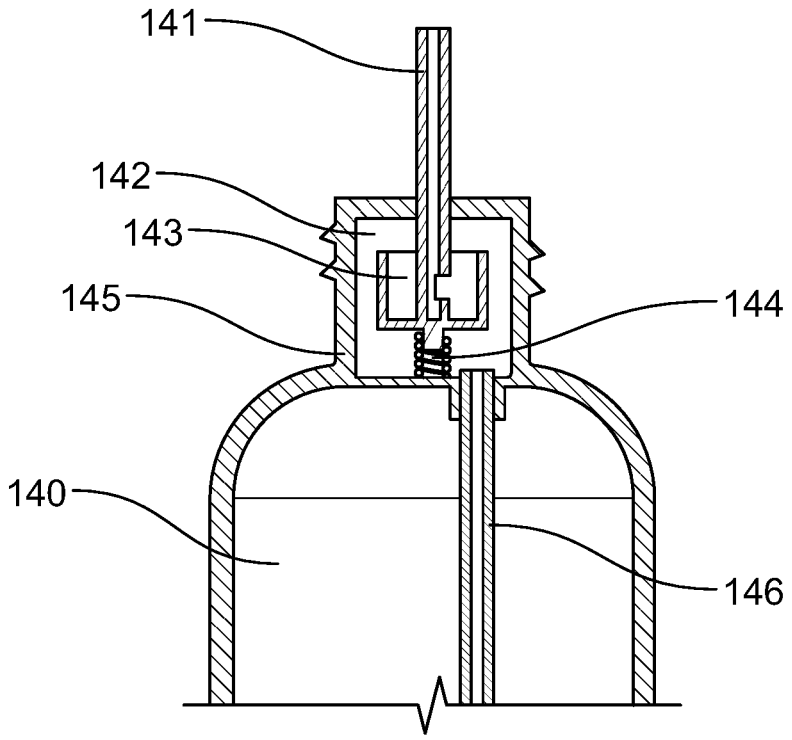
FIG. 25B illustrates an embodiment of a side cut-away view of a deodorizer housing unit, which includes an aerosol container and an actuator configured to deliver a deodorizer solution to a toilet bowl.

FIGS. 25A and 25B illustrate an embodiment of a side cut-away view of a deodorizer housing unit 120, which includes an aerosol container 140 and an actuator 122 configured to deliver a deodorizer solution to a toilet bowl. Also shown in these figures is the outlet tube 137 and opening 138, a valve stem 141 on top of the container, gasket 142, valve cup 143, spring 144, valve housing unit 145, and a dip tube 146.

In some embodiments, the aerosol container includes a liquified gas, such as butane or propane, which is used as a propellant for delivery of the liquid deodorizer solution. In a typical aerosol configuration, some of the propellant exists as a gas under pressure above the liquid solution. When the actuator 122 is pressed downwards, this forces the valve cup 143 down and compresses the spring 144 in the valve housing unit 145. Then, the gas present in the container pushes on the liquid deodorizer solution, forcing the liquid up through the dip tube 146, past the spring 144 and valve cup 143 and out the valve stem 141 and into the outlet tube 137. The expelled liquid is a mixture of the liquid deodorizer solution and the liquified gas. Conversely, when the actuator 122 is released, the spring 144 elongates and forces the valve cup 143 up thereby covering the valve stem 141 and preventing escape of the liquid.

Figure 26:
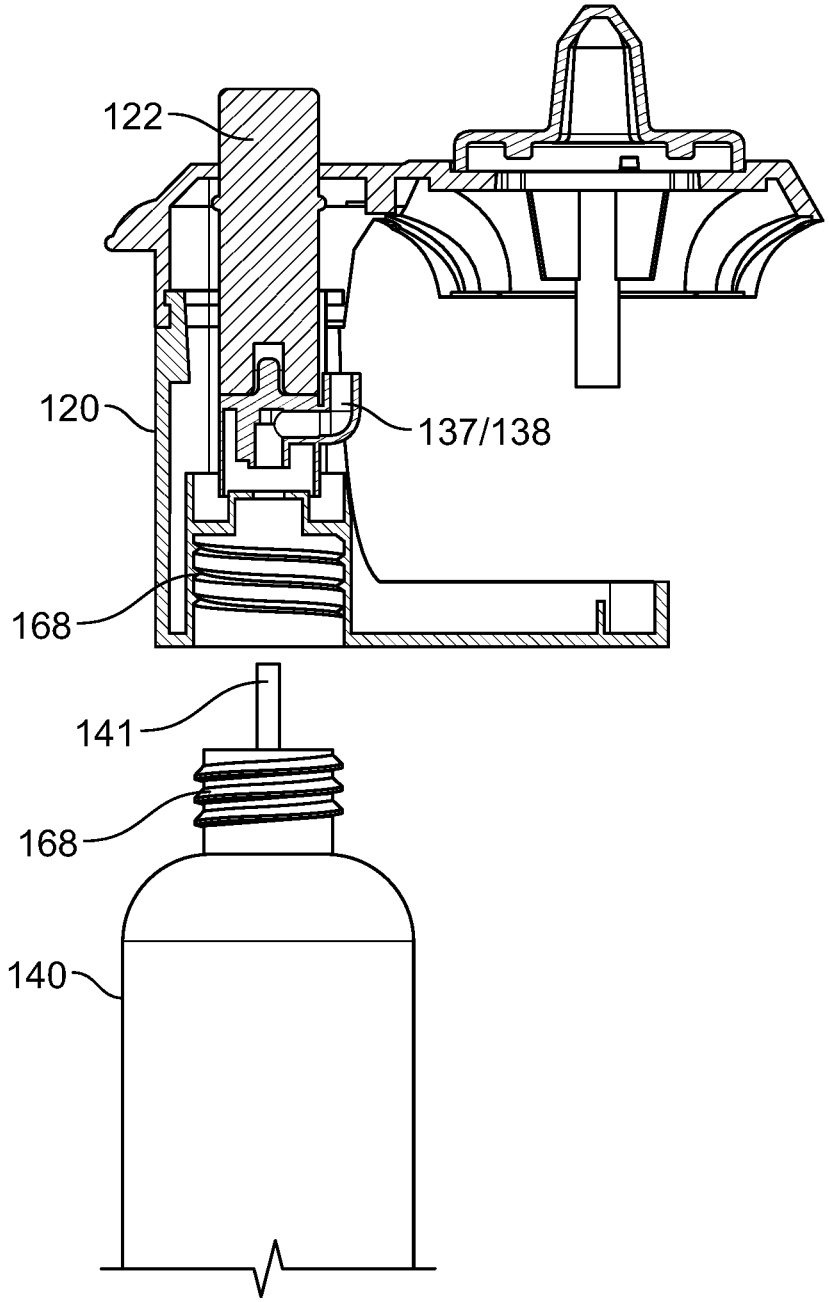
FIG. 26 illustrates an embodiment of a side cut-away exploded view of a deodorizer housing unit, which includes an aerosol container and actuator.

FIG. 26 illustrates an embodiment of a side cut-away exploded view of a deodorizer housing unit 120, which includes the aerosol container 140 and actuator 122.

In some embodiments, the deodorizer container can be reversibly attachable to the housing unit through a screw-on, threaded type mechanism 168, or can be snapped on, or can be secured permanently or reversibly or by any other means known in the art. In addition, a gasket can be used between the actuator and the valve stem, which prevents leakage of the deodorizer solution.

Figure 27:
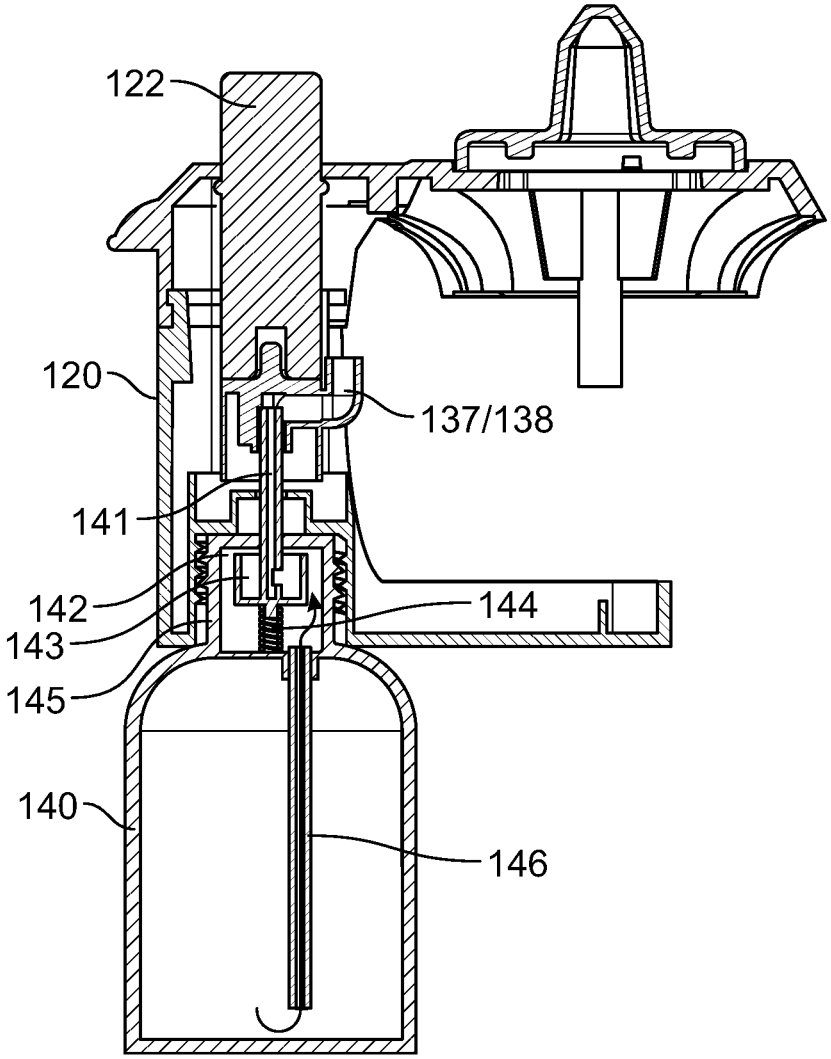
FIG. 27 illustrate an embodiment of a side cut-away view of the housing unit, which includes the aerosol container and the actuator, when in an inactivated position.
Figure 28:
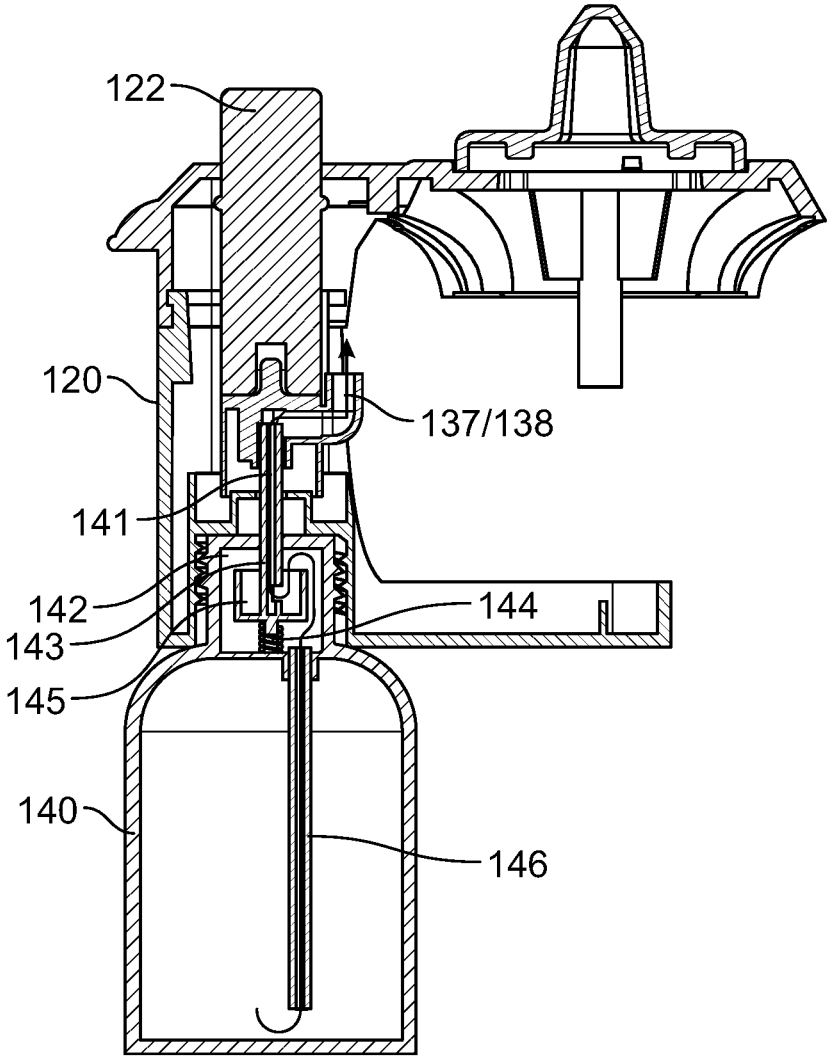
FIG. 28 illustrate an embodiment of a side cut-away view of the housing unit, which includes the aerosol container and the actuator, when in an activated position.

FIGS. 27 and 28 illustrate an embodiment of a side cut-away view of the housing unit 120, which includes the aerosol container 140 and the actuator 122, when in an inactivated and an activated position, respectively. As shown in these figures, when the actuator 122 is not engaged, the deodorizer solution stays in the aerosol container 140 due to the valve cup 143 closing off the valve stem 141. By contrast, when the actuator 122 is engaged, e.g., by manually pushing the actuator downwards, the deodorizer solution is expelled from the aerosol container 140 through the dip tube 146, into the valve housing unit 145, past the valve cup 143, into an opening in the valve stem 141, out through the outlet tube 137, and into a deodorizer tube (not shown) for delivery to a toilet bowl through a deodorizer spray or drop outlet (not shown) as described above.

While the inventive natures have been particularly shown and described concerning preferred embodiments thereof, it will be understood by those in the art that the foregoing and other changes can be made therein without departing from the spirit and the scope of the disclosure. Likewise, the various diagrams may depict an example architectural or other configuration for the disclosure, which is done to aid in understanding the features and functionality that can be included in the disclosure. The disclosure is not restricted to the illustrated example architectures or configurations but can be implemented using a variety of alternative architectures and configurations. Additionally, although the disclosure is described above in terms of various exemplary embodiments and implementations, it should be understood that the various features and functionality described in one or more of the individual embodiments are not limited in their applicability to the particular embodiment with which they are described. They instead can be applied alone or in some combination, to one or more of the other embodiments of the disclosure, whether or not such embodiments are described, and whether or not such features are presented as being a part of a described embodiment. Thus, the breadth and scope of the disclosure should not be limited by any of the above-described exemplary embodiments.

What is claimed is:

1. A bidet washing apparatus, comprising:

a control unit fluidically connected to one or more water inlets configured to supply water to the control unit, the control unit including one or more control unit switches configured to operate one or more control unit valves for controlling water flow from the one or more water inlets and/or from one or more control unit outlets;

a deodorizer housing unit, wherein the housing unit includes a deodorizer container, and a deodorizer pump;

a deodorizer tube fluidically connected to the deodorizer pump;

a deodorizer spray or drop outlet fluidically connected to the deodorizer tube; and a nozzle assembly including at least one washing nozzle fluidically connected to at least one of the one or more control unit outlets with one or more control unit outlet to nozzle assembly water tubes.

2. The bidet washing apparatus of claim 1, wherein the deodorizer housing unit, the deodorizer container, and the deodorizer pump are attachable to the control unit.

3. The bidet washing apparatus of claim 1, wherein the deodorizer pump includes a deodorizer actuator.

4. The bidet washing apparatus of claim 1, wherein the deodorizer pump is a bottle pump.

5. The bidet washing apparatus of claim 1, wherein the deodorizer pump includes a pump chamber, a spring, a ball, a piston, a pump tube inlet, and a pump tube outlet.

6. The bidet washing apparatus of claim 1, wherein the deodorizer spray or drop outlet is reversibly attachable to the nozzle assembly.

7. A bidet washing apparatus, comprising:

a control unit fluidically connected to one or more water inlets configured to supply water to the control unit, the control unit including one or more control unit switches configured to operate one or more control unit valves for controlling water flow from the one or more water inlets and/or from one or more control unit outlets;

a deodorizer container and a deodorizer pump, wherein the deodorizer container and the deodorizer pump are located within the control unit;

a deodorizer tube fluidically connected te to the deodorizer pump;

a deodorizer spray or drop outlet fluidically connected to the deodorizer tube; and a nozzle assembly including at least one washing nozzle fluidically connected to at least one of the one or more control unit outlets with one or more control unit outlet to nozzle assembly water tubes.

8. The bidet washing apparatus of claim 7, wherein the deodorizer pump includes a deodorizer actuator.

9. The bidet washing apparatus of claim 7, wherein the deodorizer pump is a bottle pump.

10. The bidet washing apparatus of claim 7, wherein the deodorizer pump includes a pump chamber, a spring, a ball, a piston, a pump tube inlet, and a pump tube outlet.

11. The bidet washing apparatus of claim 7, wherein the deodorizer spray or drop outlet is reversibly attachable to the nozzle assembly.

12. A bidet washing apparatus, comprising:

a control unit fluidically connected to one or more water inlets configured to supply water to the control unit, the control unit including one or more control unit switches configured to operate one or more control unit valves for controlling water flow from the one or more water inlets and/or from one or more control unit outlets;

a deodorizer housing unit, wherein the housing unit includes a deodorizer container, and a deodorizer pump, and wherein the deodorizer housing unit is located distal to the control unit;

a deodorizer tube fluidically connected to the deodorizer pump;

a deodorizer spray or drop outlet fluidically connected to the deodorizer tube; and a nozzle assembly including at least one washing nozzle fluidically connected to at least one of the one or more control unit outlets with one or more control unit outlet to nozzle assembly water tubes.

13. The bidet washing apparatus of claim 12, wherein the deodorizer pump includes a deodorizer actuator.

14. The bidet washing apparatus of claim 12, wherein the deodorizer pump is a bottle pump.

15. The bidet washing apparatus of claim 12, wherein the deodorizer pump includes a pump chamber, a spring, a ball, a piston, a pump tube inlet, and a pump tube outlet.

16. The bidet washing apparatus of claim 12, wherein the deodorizer spray or drop outlet is reversibly attachable to the nozzle assembly.

17. A bidet washing apparatus, comprising:

a control unit fluidically connected to one or more water inlets configured to supply water to the control unit, the control unit including one or more control unit switches configured to operate one or more control unit valves for controlling water flow from the one or more water inlets and/or from one or more control unit outlets;

a deodorizer housing unit, wherein the housing unit includes a deodorizer aerosol container;

a deodorizer tube fluidically connected to the deodorizer aerosol container;

a deodorizer spray or drop outlet fluidically connected to the deodorizer tube; and a nozzle assembly including at least one washing nozzle fluidically connected to at least one of the one or more control unit outlets with one or more control unit outlet to nozzle assembly water tubes.

18. The bidet washing apparatus of claim 17, wherein the deodorizer housing unit and the deodorizer aerosol container are attachable to the control unit.

19. The bidet washing apparatus of claim 17, wherein the deodorizer spray or drop outlet is reversibly attachable to the nozzle assembly.

20. The bidet washing apparatus of claim 17, wherein the deodorizer housing unit and deodorizer aerosol container are located within the control unit, or are located distal to the control unit.

* * * * *